US010962312B1

(12) United States Patent
Holthaus et al.

(10) Patent No.: US 10,962,312 B1
(45) Date of Patent: Mar. 30, 2021

(54) BREECH SYSTEM FOR A FIREARM

(71) Applicants: Georg Holthaus, Kitzingen (DE); Wilfried Alber, Volkach (DE)

(72) Inventors: Georg Holthaus, Kitzingen (DE); Wilfried Alber, Volkach (DE)

( * ) Notice: Subject to any disclaimer, the term of this patent is extended or adjusted under 35 U.S.C. 154(b) by 0 days.

(21) Appl. No.: 16/747,332

(22) Filed: Jan. 20, 2020

(30) Foreign Application Priority Data

Dec. 3, 2019 (DE) ..... 10 2019 132 880.2

(51) Int. Cl.
*F41A 3/16* (2006.01)
*F41A 3/66* (2006.01)

(52) U.S. Cl.
CPC . *F41A 3/16* (2013.01); *F41A 3/66* (2013.01)

(58) Field of Classification Search
CPC ..... F41A 3/16; F41A 3/66
USPC ..... 42/16
See application file for complete search history.

(56) References Cited

U.S. PATENT DOCUMENTS 2,424,264 A * 7/1947 Yorks ..... F41A 3/26 89/185
2,811,902 A * 11/1957 Dixon ..... F41A 5/02 89/165
2,941,449 A * 6/1960 Reed ..... F41A 3/26 89/185
3,027,672 A * 4/1962 Sullivan ..... F41A 21/482 42/16
3,330,108 A * 7/1967 Kvavle ..... B25C 1/186 60/634
4,402,152 A 9/1983 Casull
4,655,118 A * 4/1987 Bruderer ..... F41A 3/30 89/185
5,014,592 A 5/1991 Zweig et al.
7,937,877 B2 5/2011 Barrett
9,958,222 B2 * 5/2018 Blank ..... F41A 15/14
2012/0073177 A1 * 3/2012 Laney ..... F42B 5/025 42/16
2017/0074609 A1 3/2017 Michlin

FOREIGN PATENT DOCUMENTS

CH 475540 A 7/1969
DE 1703549 A1 8/1972
DE 3906496 A1 9/1990
GB 191501923 A 2/1915

* cited by examiner

*Primary Examiner* — Samir Abdosh
(74) *Attorney, Agent, or Firm* — Saliwanchik, Lloyd & Eisenschenk

(57) ABSTRACT

The invention relates to a breech system for a firearm, having a bolt receiver and a bolt; the bolt receiver is embodied in the form of a hollow cylinder at least with engagement means protruding radially inward and there is also at least one bolt head, which has outward-protruding engagement means that correspond to the inward-protruding engagement means; the bolt head is supported in rotary fashion on a bolt carrier and there is also a bolt body, which is able to slide on a bolt head shaft of the bolt head, and between the bolt body and the bolt carrier, there is at least one compression spring, which tends to move the bolt body in the direction toward the bolt head; and on the bolt head shaft and on the bolt body, there are means that produce a rotation of the bolt head when the bolt body is slid on the bolt head shaft.

18 Claims, 32 Drawing Sheets

BREECH SYSTEM FOR A FIREARM

CROSS-REFERENCE TO RELATED APPLICATION

Figure 1:
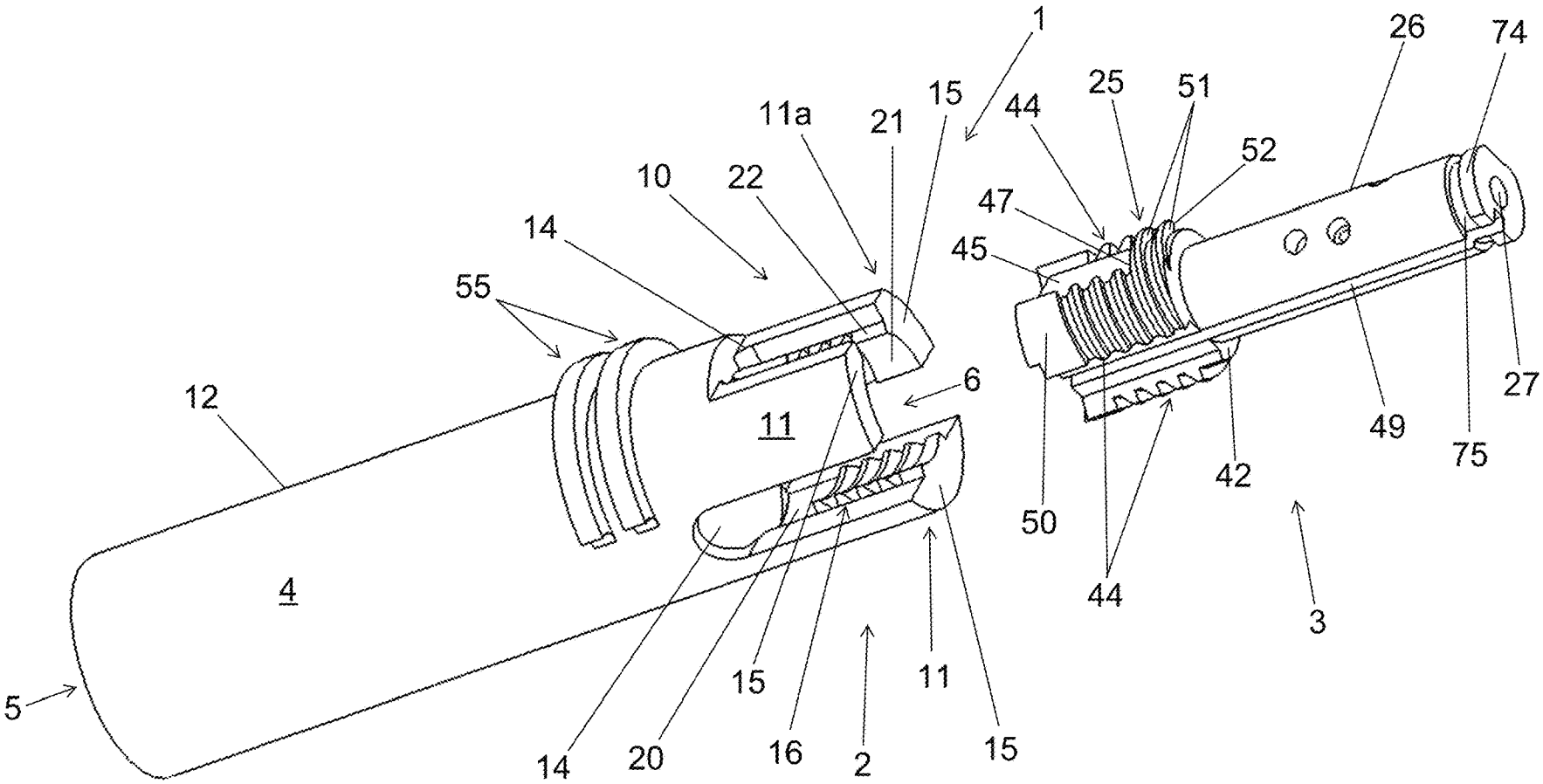

This application claims priority to German Application No. 10 2019 132 880.2, filed Dec. 3, 2019; which is hereby incorporated by reference in its entirety.

The invention relates to a breech system for a firearm according to the preamble to claim 1.

In modern firearms, a bullet is driven through a barrel by means of a gas that is produced in particular through combustion of a propellant and is expelled from the barrel. The barrel dictates the direction of the bullet and also provides the bullet with a rapid spin around the longitudinal axis, which according to the principle of gyroscopic stabilization, stabilizes the bullet in its flight phase.

In order to be able to fire the bullet, bullets are part of a cartridge, the cartridge consisting of a cartridge case, usually made of brass, a propellant contained in the case, usually composed of nitrocellulose propellant, and primer. The primer is mounted in the case head, which is situated at the opposite end from the case neck and the case mouth into which the bullet is inserted.

A cartridge is supported in a region at the axially opposite end from the muzzle, namely the cartridge chamber; the cartridge chamber has an inner contour, which largely corresponds to the outer contour of the cartridge case and, depending on the design of the firearm, completely contains the cartridge or a breech face region of the cartridge protrudes from the cartridge chamber toward the rear, i.e. in a direction opposite from the direction of fire.

During firing, the hot powder gases, which are produced by the combustion of the propellant, expand and push the bullet in the direction of fire into the barrel. In order to ensure a correct guidance and introduction of the bullet into the usually smaller-diameter regions of the barrel profile, a forcing cone is provided in the region of which the diameter of the barrel decreases to the predetermined caliber.

The force of the expanding powder gases acts on the bullet on the one hand, but also on the cartridge case on the other so that a force oriented rearward in the direction of fire acts on the case and a radial expansion also presses the case wall against the cartridge chamber wall. This so-called "tightening" is desirable since on the one hand, it produces a temporary gas-tightness and on the other, counteracts the rearward-oriented force of the powder gases with a frictional engagement.

In order to hold the cartridge in the cartridge chamber during firing and to close the cartridge chamber toward the rear, firearms have so-called breeches. The different breech types are, for example, breaking breech-block actions (Jager system), tilting breech-block actions (Blaser system), falling breech-block actions or vertical breech-block actions, and bolt actions.

Usually, the breeches also include a striker or firing pin in order to ignite the primer resting against the breech or more specifically, against the breech face of the breech, by the sudden crushing thereof and thus to ignite the propellant.

Repeating firearms and usually also semiautomatic rifles are equipped with so-called bolt actions. At the barrel end where the cartridge chamber is located, there is usually a bolt housing, a so-called bolt receiver, in which a cylindrical bolt element, the so-called chamber, can move back and forth axially. When closed, this chamber is locked either directly to the barrel or to the bolt receiver in such a way that by means of the breech face, i.e. the axial front surface of the breech, the cartridge is immobilized in the cartridge chamber.

In known bolt-action rifles, the bolt cylinder is moved manually in the bolt receiver in order to open the cartridge chamber or close the cartridge chamber. By manually sliding it backward and forward again, an empty cartridge case is removed from the cartridge chamber and ejected, a new cartridge from a magazine is inserted into the cartridge chamber from behind, and then the cartridge chamber is locked. In conventional rotating bolt actions with a bolt handle, in order to unlock and lock the breech, the cylinder must be rotated with the bolt handle before it can be opened.

The locking is performed by means of a different number of locking elements, which can be composed of locking projections, which engage in corresponding recesses in the barrel or the bolt receiver. Between the bolt cylinder and the bolt receiver on the one hand or between the bolt cylinder and the barrel on the other (so-called direct locking) a rear-engagement locking is carried out in which the rear-engagement of the locking projections produces an axial immobilization of the bolt chamber in the bolt receiver or in the barrel.

In this case, the species-defining system with a safety can be seen in the Mauser 98 system; this system is a further development of previous Mauser systems.

In automatic and semiautomatic weapons, there are also bolt actions in which the bolt cylinder can be pulled back manually in the sleeve to cock the weapon, but can also be unlocked by the recoil alone (recoil-operated weapons) or unlocked by a combination of the recoil and a gas supply (gas-operated weapons) in order to then supply a new cartridge by means of corresponding tongue elements and be relocked. An example of this is the Browning BAR system in which the breech is unlocked by means of a gas supply and the bolt is returned by the gas pressure acting on the cartridge combined with the recoil. The bolt actions of such automatic or semiautomatic systems, however, even of so-called straight-pull bolt-action rifles, are usually composed of two parts, one part that executes the linear motion in the sleeve while a front part, the so-called bolt head, executes the locking in the barrel or in the front region of the bolt receiver. The bolt head and the rear part of the bolt action in this case are embodied so that they are able to rotate relative to each other; a control cam is provided for the defined rotation of the bolt head and converts the linear motion of the rear part of the bolt during the forward stroke or rearward stroke into a rotary motion of the bolt head, which results in the locking or unlocking.

As stated above, the locking or unlocking here can be executed in a gas-operated or recoil-operated way, but it can also be executed in a purely manual fashion, as in straight-pull bolt-action rifles so that it is particularly also possible to actuate a breech system provided for semiautomatic weapons in a purely manual fashion, as exhibited by the modified Browning BAR system for the Browning "Maral" straight-pull bolt-action rifle.

Self-loading systems that are modified for manual operation basically have the disadvantage that the feed spring, which closes the breech and supplies the cartridge, with a manual rearward motion of the bolt results in the fact that in the same way as the motion for the initial loading of a recoil-operated weapon, the retracting motion becomes increasingly difficult as the retracting motion continues.

In heavy firearm systems, the so-called threaded breech is used, among others. The threaded breech is a breech design particularly for cannons. It is primarily used in large-caliber cannons, for example the M109 armored howitzer. Threaded breeches share the fact that the cannon barrel and a moving breech part (the bolt cylinder) have corresponding external and internal thread. The Rohr is closed at the rear by screwing it shut before the firing so that the bolt cylinder immobilizes the cartridge in the cartridge chamber of the Rohr. In this connection, so-called systems with interrupted threads; in this connection, "interrupted" means that radially on the breech and in the barrel, there are at least two segments provided with a screw thread whereas the rest are smooth and in this location, have a diameter that is embodied so that the screw threads protrude out from it. In this case, the breech screw is supported so that it can be slid axially in a swivel arm; the screw is rotated by 90° for opening and closing. Approximately 50% of the thread circumference is used for the locking in this case (namely the two thread segments) so that with sufficient dimensioning of the breech, it is possible to control high gas pressures.

The first breech designs were locked by a 90° rotation of the screw ("Reffye" system, "De Lahitolle" system, "Baranowski" system) while there were also systems that had three screw segments and thus also three smooth elements, the so-called "De Bange" system. For example, such breeches were also embodied as conical or oval breeches. At the beginning of the 20$^{th}$ century, efforts based on threaded breeches were aimed at designing a so-called comb breech in which the screw thread was replaced by parallel combs without a pitch, but these have not stood the test of time. The Armstrong Whitworth screw breech system differs from the other threaded breeches in that a trapezoidal thread is used, but this is not a screw breech in the narrower sense because a metallic block is inserted into the barrel from above and only the locking is produced with frictional engagement by means of a screw, which is screwed into the barrel from the rear or is screwed onto the barrel and presses the metal block against the rear edge of the powder chamber. This design therefore combines elements of the sliding wedge and threaded breech.

The object of the invention is to create a breech system for firearms, which while being simple and reliable to operate, ensures extremely high breech safety and can be used for both rotating bolt actions and rotating bolt head actions and thus for manual repeaters or straight-pull bolt-action weapons and also for fully automatic and semiautomatic weapons.

The object is attained with a breech system having the features of claim 1.

Advantageous modifications are disclosed in the dependent claims.

According to the invention, the breech system has a bolt head and a bolt receiver, the two having mutually corresponding engagement means that can be brought into engagement through a rotary motion.

As the corresponding engagement means, threaded sections are provided, which have a pitch or no pitch and have thread combs that are positioned axially one after another in comb-like fashion.

According to the invention, the bolt thread is embodied as a so-called buttress thread. In conventional buttress threads one flank of the thread is embodied as cross-sectionally inclined while the second flank of the same thread is cross-sectionally oriented radially, i.e. perpendicular to the longitudinal axis.

By contrast with the conventional embodiment of a buttress thread, the bolt thread according to the invention is embodied as a buttress thread in which both flanks of the thread are cross-sectionally inclined in the same direction, but in a sharp thread, one of the thread flanks is more steeply inclined than the other.

Particularly in a sharp thread, the front flank relative to the direction of fire is more steeply inclined than the rear flank relative to the direction of fire.

Because of the inclination of the rear flank, with a commensurate embodiment of the corresponding internal thread of the barrel or of the barrel extension in the locked state, when a force is introduced axially onto the bolt in a direction opposite from the direction of fire, the thread or the two thread segments is pulled into each other by the cooperation and thus reinforces the blocking action.

According to the invention, the buttress thread or buttress thread segments of the breech in this case can be embodied as a sharp thread or trapezoidal thread.

The bolt head on the one hand and the barrel or barrel extension serving as a bolt receiver on the other can be embodied with two, three, or more thread segments and a corresponding number of smooth regions or recessed regions.

According to the invention, between the first part, which through an axial motion causes a rotation of the bolt head, and a second part, which does not execute any axial motion relative to the bolt head, a spring force can also be exerted within the breech in such a way that the bolt head is held by the spring force in the locked state and the bolt head rotation into a bolt head recess is carried out with spring assistance.

In this connection, it is advantageous that a particularly easy, gentle repeating process can be carried out.

For example, the invention contemplates developing a breech for a firearm and particularly for a handgun and among other things, to combine a threaded breech with the features of a conventional rotating bolt action or rotating bolt head action so that a simple loading, firing, and unloading of the gun or firearm is possible with a maximized safety of this breech system. Basically, the invention enables an operative connection between the breech and the barrel directly or between the breech and a barrel extension containing the barrel and thus with the barrel indirectly.

The provision of a bolt carrier and a bolt body, which is supported in a sliding and axially spring-loaded fashion thereon, as well as locking mechanisms between the bolt body and bolt head and bolt head shaft makes it possible to ensure a particularly reliable function.

According to the invention, in order to increase the variability of a firearm when it comes to the choice of caliber, both for the buyer and also in terms of the manufacture, a barrel extension is used in which the barrel is screwed into the essentially cylindrical barrel extension in a direction opposite from the direction of fire, with an axial immobilization being possible by means of an axial end of the receiving thread after which the inner diameter of the barrel extension is preferably smaller so that the threaded end uniquely defines the position of the barrel in the barrel extension.

In addition, as a bolt receiver in a cylindrical region between the inner barrel receptacle and the receptacle for the bolt action that is oriented away from it in the direction of fire, the barrel extension preferably has at least one outer radial projection serving as a radial bolt tongue, more preferably two or more bolt tongues arranged axially in series, for example with an arc length of 180° relative to the circumference of the barrel extension, with which the barrel and barrel extension can be inserted in the direction of fire into a recess or into a corresponding groove or grooves of a base body (chassis) of a firearm and can be immobilized there through rotation. To accomplish this, when the barrel and barrel extension are inserted into the recess from the rear, after reaching the stop, the barrel extension is rotated by 180° into the corresponding bolt grooves in the recess.

As is customary with rotating bolts, with the bolt according to the invention, in order for the bolt to be inserted until reaching a position in which it can be rotated and thus locked, it is also necessary for there to be engaging elements that alternate with regions in which there are no engaging elements.

Since according to the invention, it is a threaded breech, it is thus necessary for there to be threaded regions that alternate with unthreaded regions. For example, there can be two diametrically opposed threaded regions and correspondingly, two smooth regions 90° offset from them. This means that in the regions in which no thread is present, i.e. the smooth regions, the bolt head there does not protrude beyond the minimum diameter of the thread at the tooth base.

When there are three or more locking regions, i.e. threaded regions, with a symmetrical arrangement, the angular offset between the threaded regions and the smooth regions is likewise always the same; thus an angle of 60° or correspondingly smaller is always maintained between the threaded regions and the smooth regions.

This then also constitutes the so-called opening angle of the breech since a rotation of the bolt by 60° in the screw-in direction of the thread until the stop is reached results in a locking and the corresponding rotation counter to the screw-in direction results in an unlocking.

In the unlocked range, the smooth regions of the bolt head are positioned between two respective adjacent threaded regions in the region of the corresponding thread of the bolt receiver and in this region, can be moved axially back and forth without coming into engagement. The threaded regions of the bolt head in this case are positioned in the smooth regions of the bolt receiver so that here, too, an axial motion is permitted.

If the bolt head is in in the position in which it is slid the farthest forward, then by means of a clockwise rotation of the bolt head, the threads of both the bolt head and the bolt receiver, which correspond to each other, can be brought into engagement until the threads of the bolt head and the bolt receiver and thus the teeth of the threads have been screwed all the way into each other.

Preferably, at least one stop surface is respectively embodied in the bolt receiver on the one hand and on the rotating bolt head on the other and these surfaces form a stop when the threads have been screwed all the way into each other, thus blocking an overtightening and thus an unscrewing of the thread in the clockwise direction.

The above-mentioned embodiments naturally also apply analogously to other possible engagement means.

Consequently, the invention relates to a breech system for a firearm, having a bolt receiver and a bolt, the bolt receiver being in the form of a hollow cylinder with at least one first engagement means protruding radially inward and at least one slot, the slot being positioned axially adjacent to the first engagement means and to a bolt head, and the bolt head having at least one protruding second engagement means and an adjacent axial flute; the first engagement means of the bolt receiver and the second engagement means of the bolt head are correspondingly embodied as being able to engage with each other; the corresponding first and second engagement means are embodied as receiving and bolt thread segments, respectively, with or without a pitch, the respective thread segments each having at least one thread comb; and a rear flank of the at least one thread comb of the bolt head is inclined away from the direction of fire and a corresponding rear flank of the at least one thread comb of the bolt receiver is inclined in the direction of fire.

Advantageously, the thread combs are embodied as sharp thread combs or trapezoidal thread combs with inclined front flanks and inclined rear flanks.

In one embodiment, the front flanks and rear flanks can have different inclinations.

In addition, the thread segments can have a pitch and a pitch of each thread comb is the same as the pitch of each respective thread segment.

It is also advantageous if the bolt head is supported in rotary fashion on a bolt carrier and there is also a bolt body, which is able to slide on a bolt head shaft of the bolt head, and between the bolt body and the bolt carrier, there is at least one compression spring, which tends to move the bolt body in the direction toward the bolt head; on the bolt head shaft and on the bolt body, there are means that produce a rotation of the bolt head when the bolt body is slid on the bolt head shaft.

In another advantageous embodiment, the bolt receiver has a plurality of cylinder segments, each with a respective receiver thread segment having at least one thread comb and between the cylinder segments, there are slots; and the slots are positioned in a circumferential wall of the bolt receiver from a radial inside to a radial outside and extend into the circumferential wall at least to a bottom of each thread comb or extend all the way through the cylindrical circumference wall.

It can also be advantageous if a plurality of thread segments with respective thread combs are embodied on the bolt head; and adjacent to the bolt thread segments, there are flutes, which at least reach the depth of bottoms of the thread combs so that the flutes interrupt a thread helix of the thread combs.

It can also be advantageous if a radial width of the slots corresponds to a radial width of the thread segments and a radial width of the flutes of the bolt head corresponds to a radial width of the cylinder segments.

In the breech system according to the invention, the bolt can also have the bolt head, a bolt head shaft adjoining the bolt head and extending axially in a direction away from a direction of fire, and a bolt body positioned around the bolt head shaft, the bolt body being supported in a rotationally fixed way so that it is able to slide axially in a firearm and located, between the bolt body and bolt head shaft, a control slide comprising a control recess and a control pin is provided, which supports the bolt head shaft so that it is able to rotate to a limited degree in the bolt body.

It is also advantageous if the bolt head has at least one thread comb, which is embodied so that it extends from a bolt thread segment into the flute and spans the flute and has an axial free end that forms a stop surface for a corresponding stop surface of a cylinder segment so that when the thread comb fully engages in the thread comb, a further screwing of the thread comb into the thread comb and a further screwing of the bolt thread segment into the receiver thread segment or cylinder segment is blocked.

With the invention, the bolt receiver is advantageously embodied in a barrel extension; the barrel extension is embodied to receive the barrel of a firearm; in addition to a bolt-locking region for receiving the bolt and the bolt head of the bolt, the barrel extension has a locking region; and in the locking region, there is at least one ring segment-like protrusion, which is embodied to cooperate with a corresponding groove in a sleeve or chassis of a firearm.

According to the invention, the bolt head shaft and the bolt body are advantageously supported on the bolt carrier; the bolt head shaft being supported on the bolt carrier in a rotatable, but axially fixed way, while the bolt body is supported on the bolt carrier in an axially sliding, but rotationally fixed way.

In one embodiment, the bolt carrier is a bolt carrier plate and protruding from it in a same direction, first and second bolt carrier longitudinal arms and, protruding from the first and second carrier arms, respective first and second ejector arms; wherein the bolt carrier plate is a flat, plate-like component, which, in relation to a longitudinal span of the bolt head shaft and a direction of fire, is embodied standing upright and has a generally rectangular cross-section; and between narrow side edges of a lower edge of the bolt carrier plate, there is a support opening for the bolt head shaft so that by means of a groove and tongue engagement, the bolt head shaft is supported on the bolt carrier plate in a rotatable but axially fixed way.

In one embodiment, the bolt body is a component with a generally T-shaped cross-section, with a first component region extending transversely and a second component region extending essentially upright; the first component region is embodied as plate-like, with a rear end wall, two longitudinal first side walls, and a front end wall; between the front and rear end walls and the first longitudinal side walls, there is a lower wall; the second component region extends downward from the middle of a lower wall with two second side walls that extend parallel to the first side walls; the second side walls are spaced apart from the first side walls in an essentially symmetrical fashion; between the second side walls, there is a bottom wall of the second component region; and in a longitudinal middle of the bottom wall is an aperture, which is embodied in a cylindrical bore extending coaxially around a longitudinal axis of the bolt body and the bolt head shaft.

In an advantageous modification, when the bolt body is inserted in the bolt carrier, a gap remains between the walls of the first and second bolt carrier longitudinal arms and the lower wall of the first component region of the bolt body; the bottom wall widens outward beyond the respective second side walls with tongue elements and corresponding grooves present in the bolt carrier plate and bolt carrier longitudinal arms; the projection of the tongue elements beyond the second side walls corresponds to a depth of the grooves so that the tongue elements are correspondingly embodied to be received in the grooves and form a tongue-and-groove system with which the bolt body is positioned in the bolt carrier in a longitudinally sliding fashion.

It is also advantageous if a locking lever is supported in an upper top surface of the bolt carrier; the locking lever is positioned so that it is tilted around a rotation axis into a slit in such a way that a catch projection, which is embodied at one end of the locking lever, reaches into a region of a bore for supporting the bolt head shaft and in this region of the bore, is able to pivot into and out of the bore; and the locking lever has an actuating lever, which is spring-loaded by the pressure of a spring in such a way that the catch projection is pivoted through the slit into the bore by means of spring pressure.

In this connection, it is also advantageous if first and second locking slits are provided in the bolt head shaft; the first and second locking slits are axial slits positioned in the surface of the bolt head shaft; the first and second locking slits are embodied so that they can correspond to the catch of the locking lever; the first and second locking slits are embodied as axially offset from each other and radially offset from each other; the second slit is farther away from the bolt head than the first slit is, but is positioned before the first slit in the rotation direction of the bolt; and the axial spacing of the slits corresponds to a depth to which the bolt threads are screwed into each other, while the radial spacing corresponds to an arc length that the bolt travels in a screwing-in direction through a complete screwing-in motion.

In an advantageous modification, the rotation of the bolt head is produced by means of an advancing motion of the bolt body; wherein the bolt body slides onto the bolt head shaft and a control pin, which rests in a control pin bore, slides along a control surface and forces the bolt head into a rotary motion, wherein in an initial position, the control pin rests in an axial recess in the control surface and with a forward motion, forces the rotation of the bolt head; and an inclined surface of the control surface is configured so that an angular offset between axial end regions of the control surface corresponds to an angular offset by which the bolt head travels when it is completely screwed in.

The invention will be explained by way of example based on the drawings.

Figure 2:
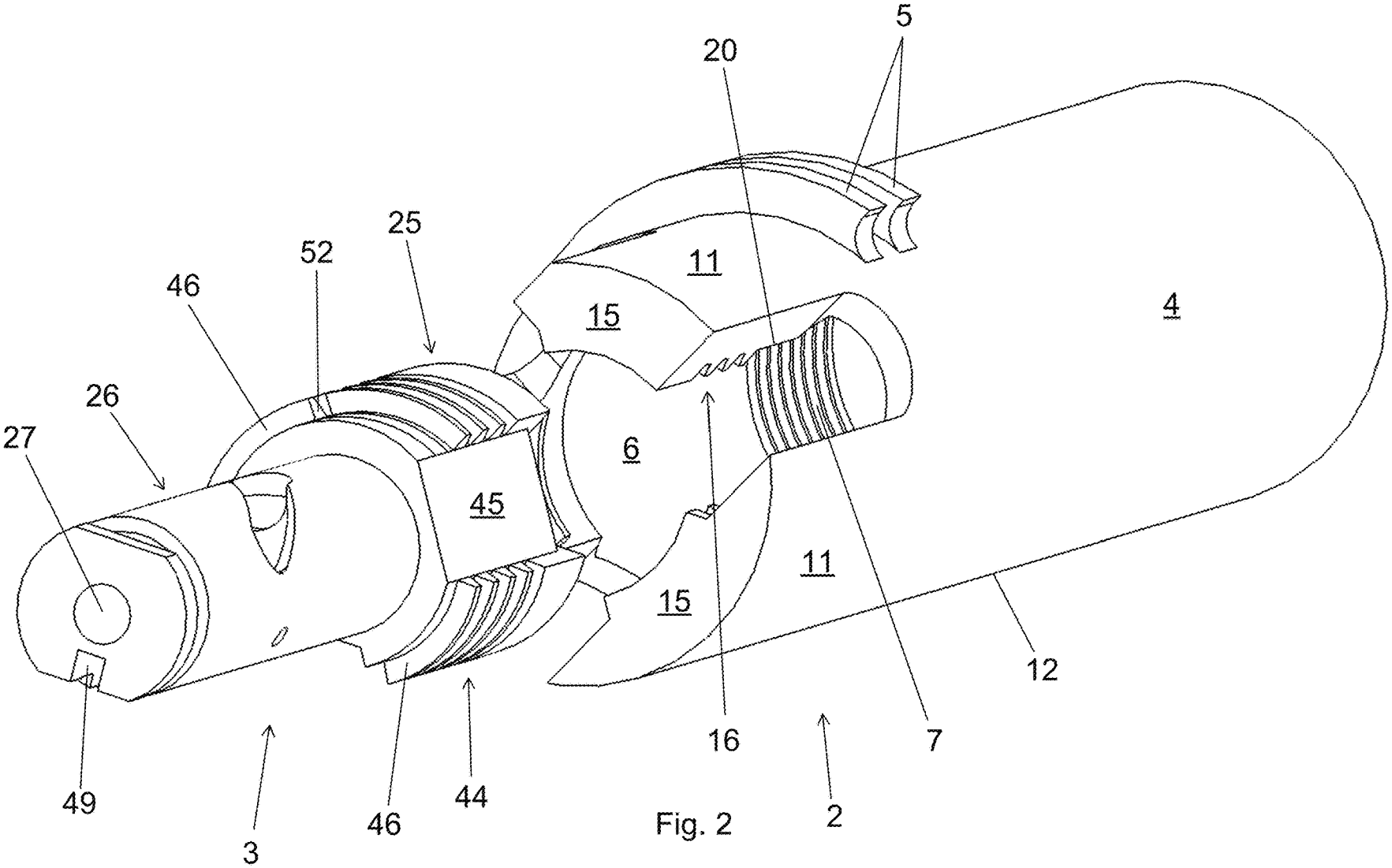
Figure 3:
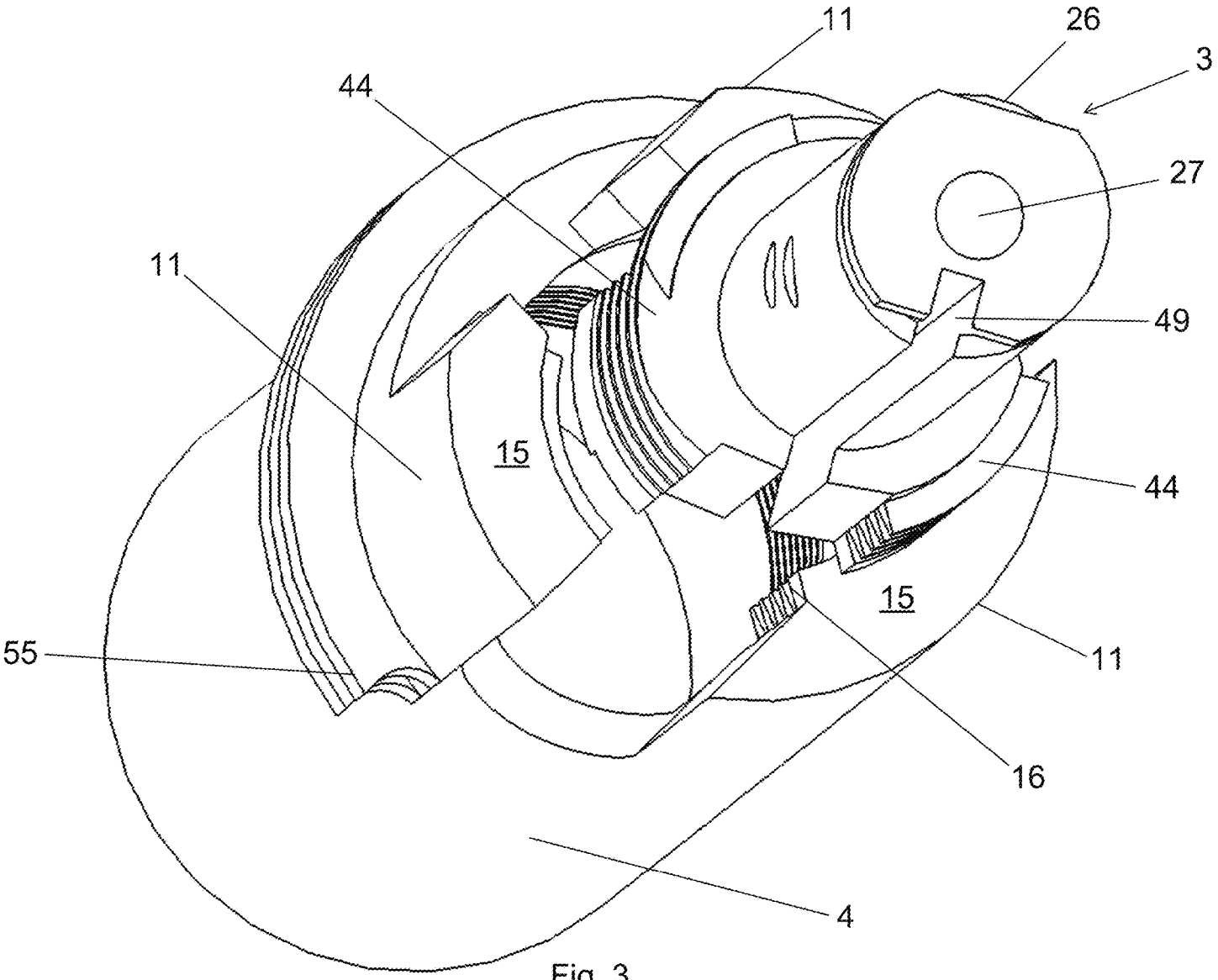
Figure 4:
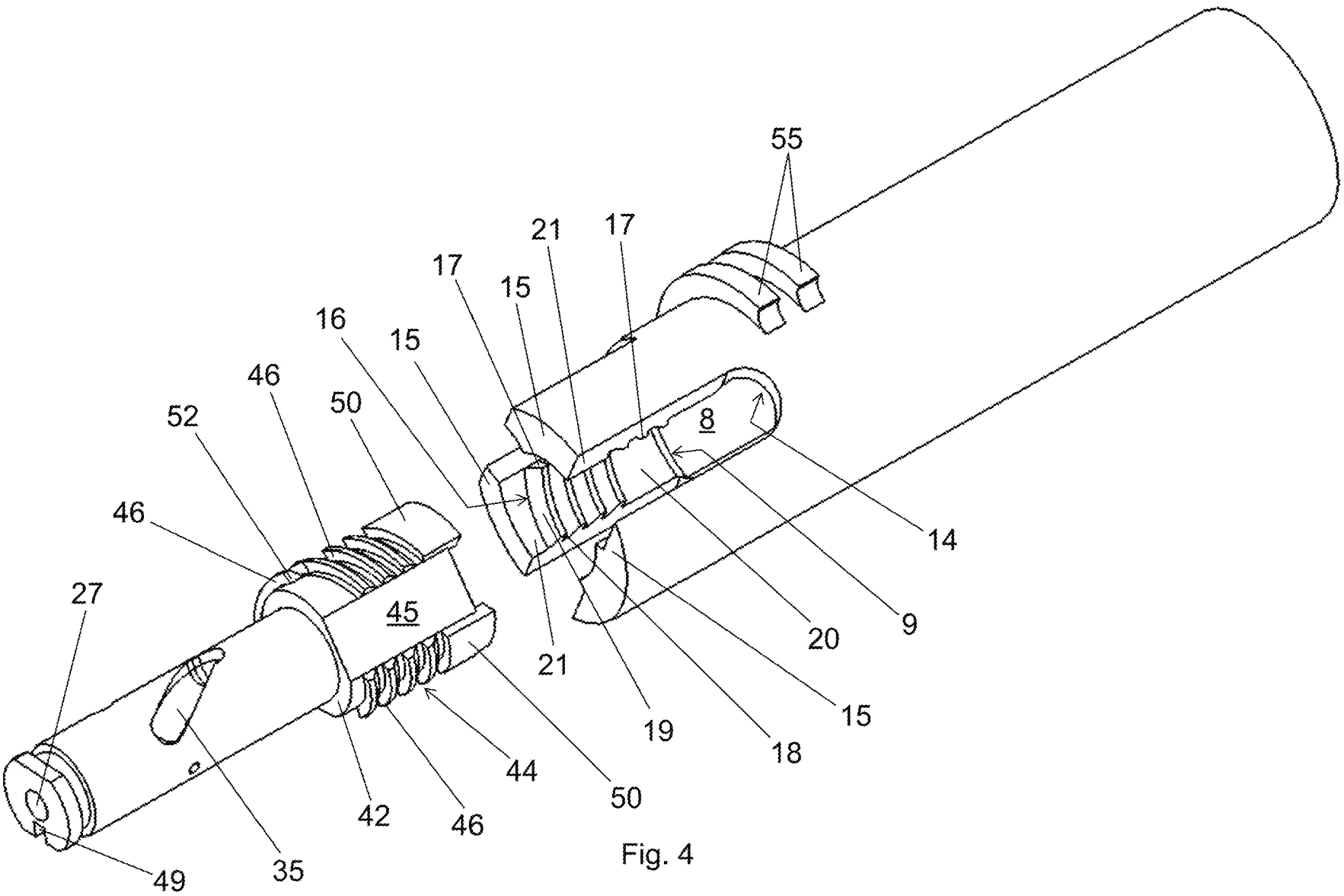
Figure 5:
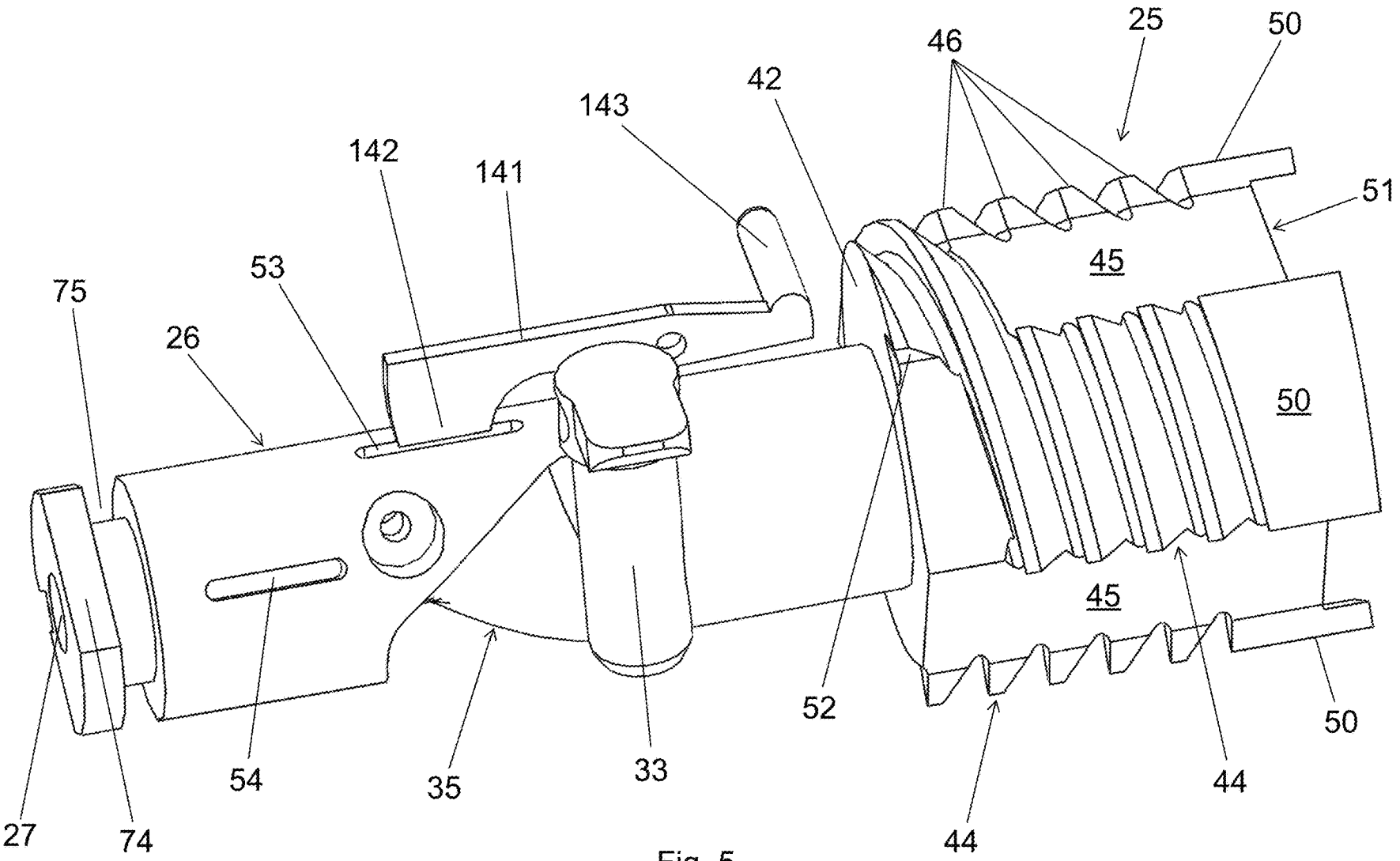
Figure 6:
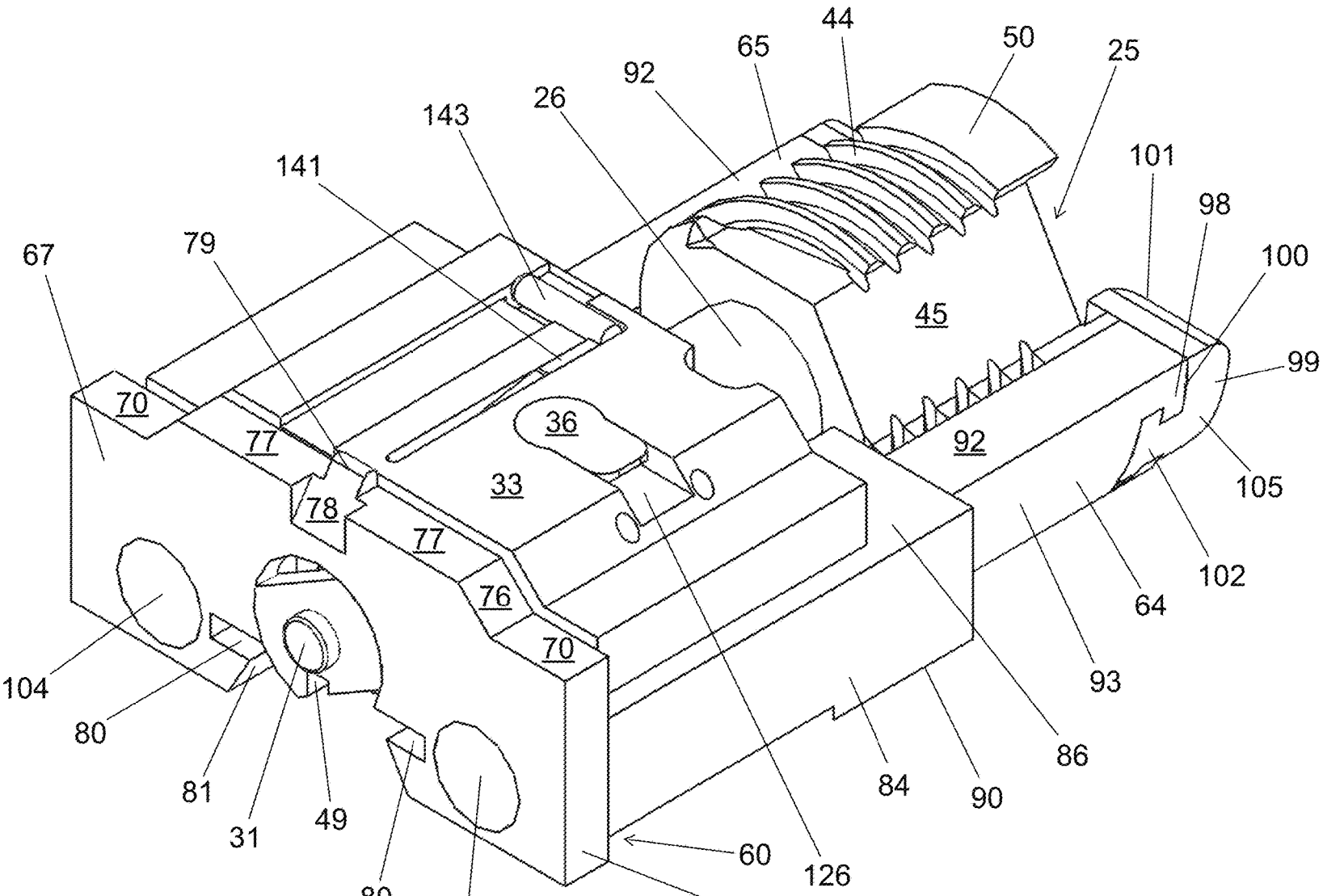
Figure 7:
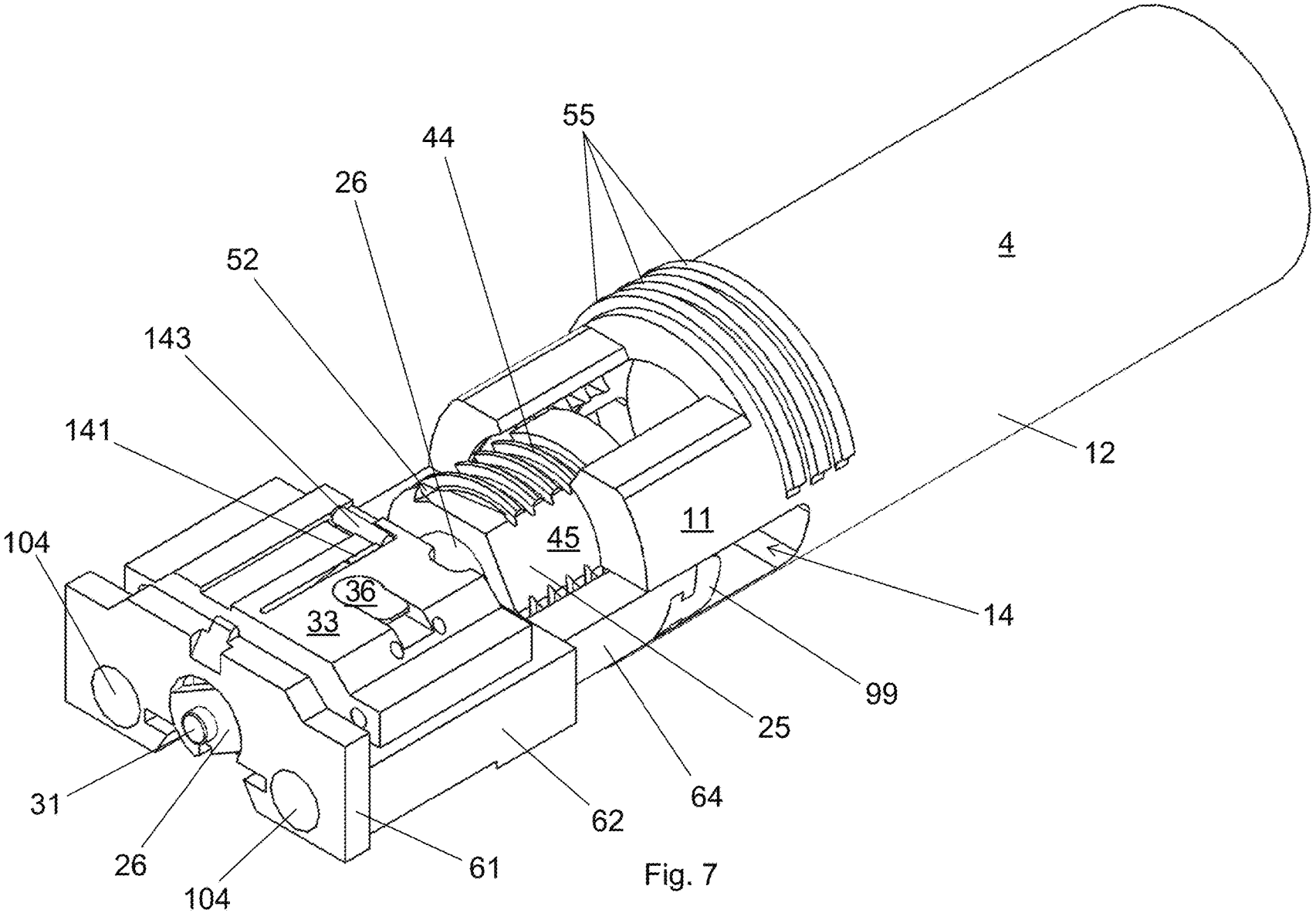
Figure 8:
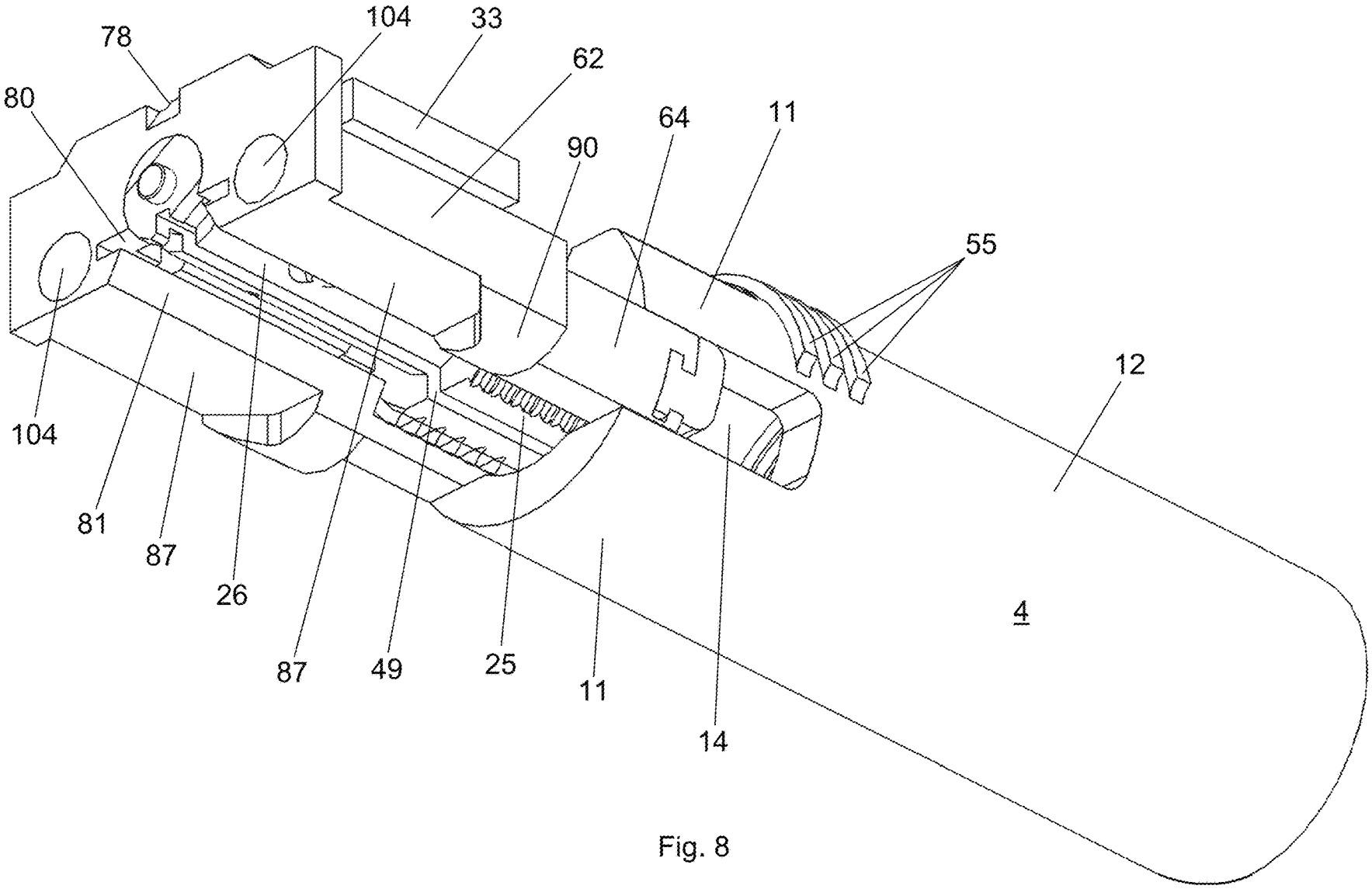
Figure 9:
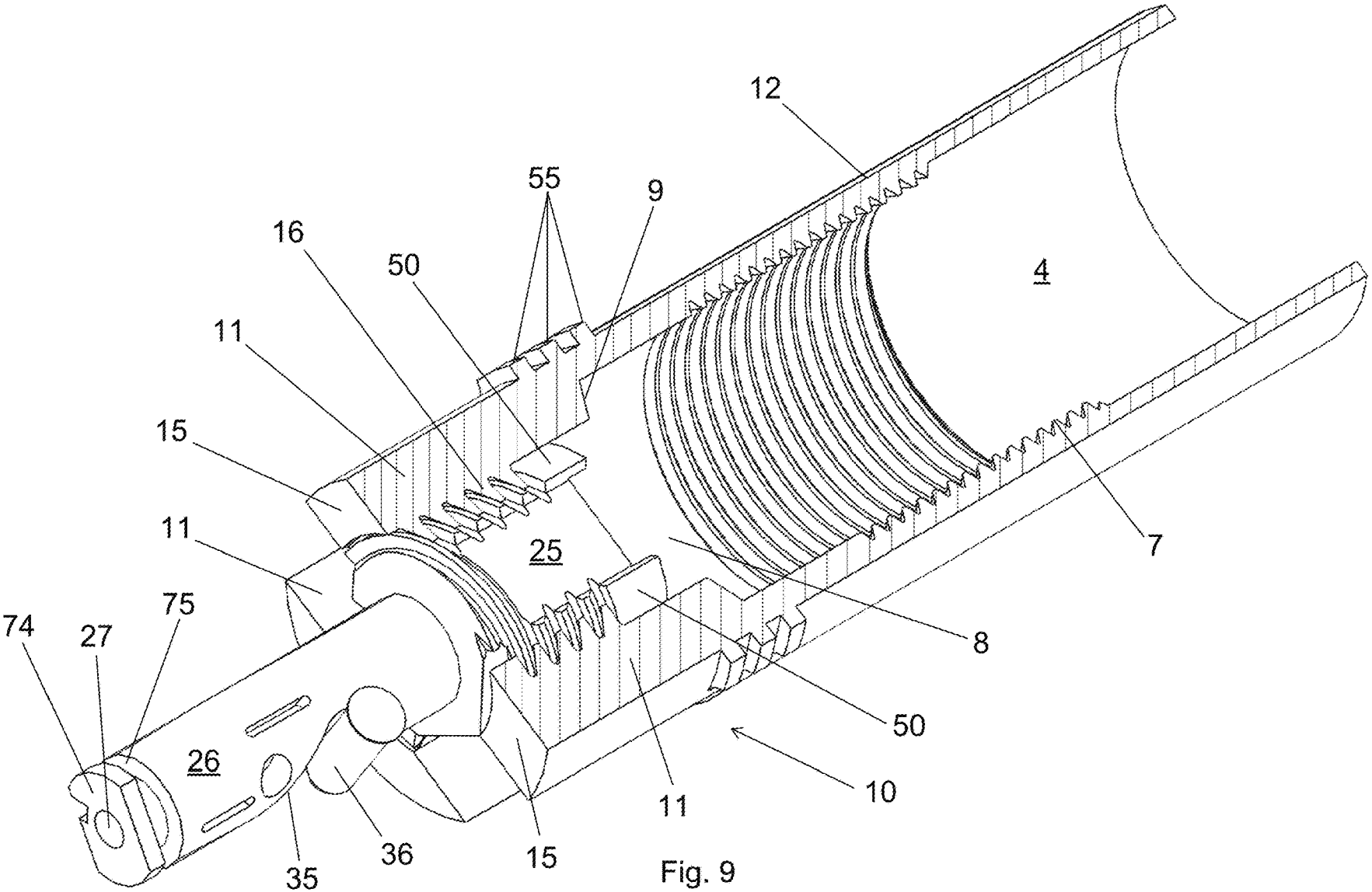
Figure 10:
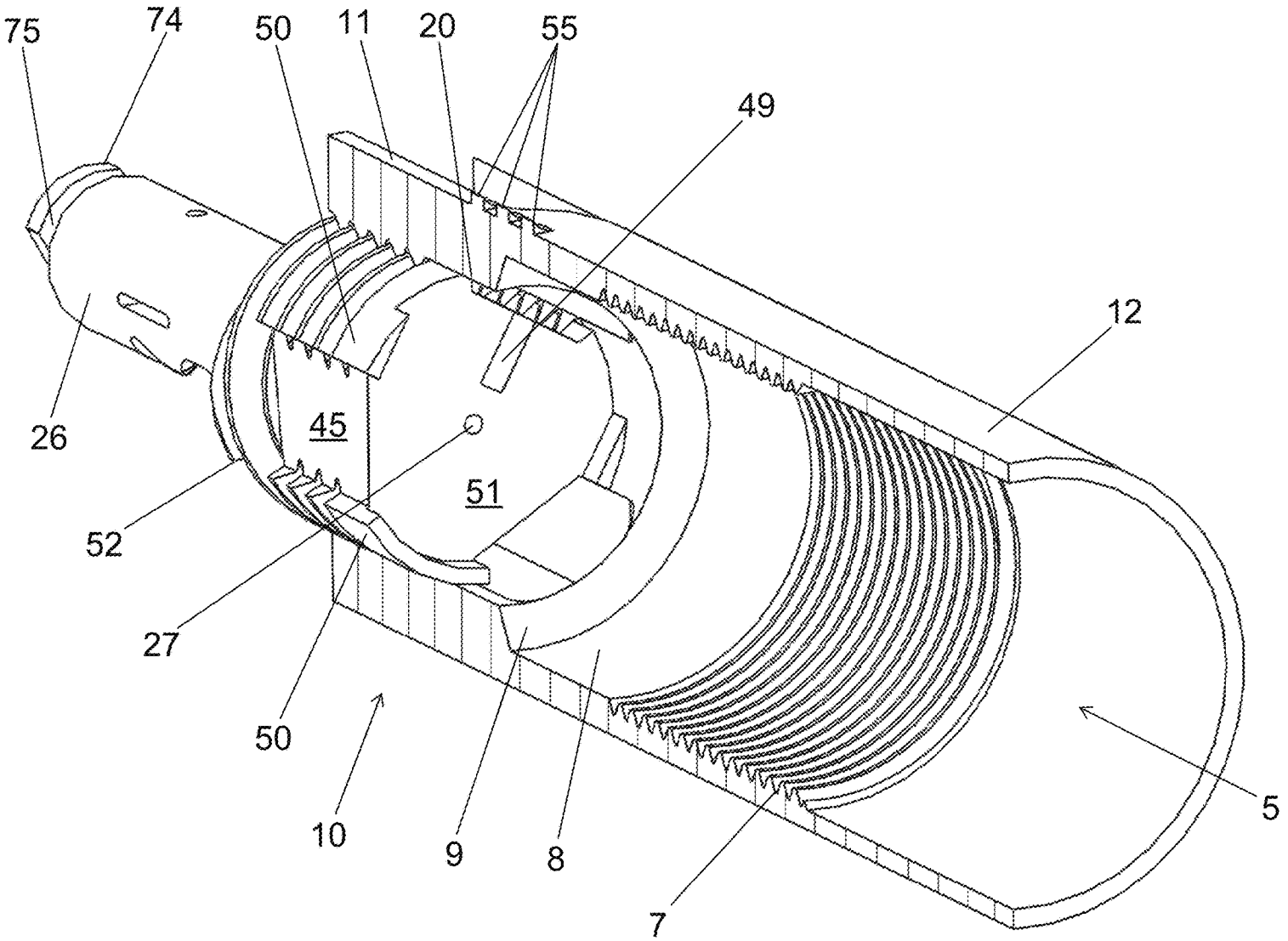
Figure 11:
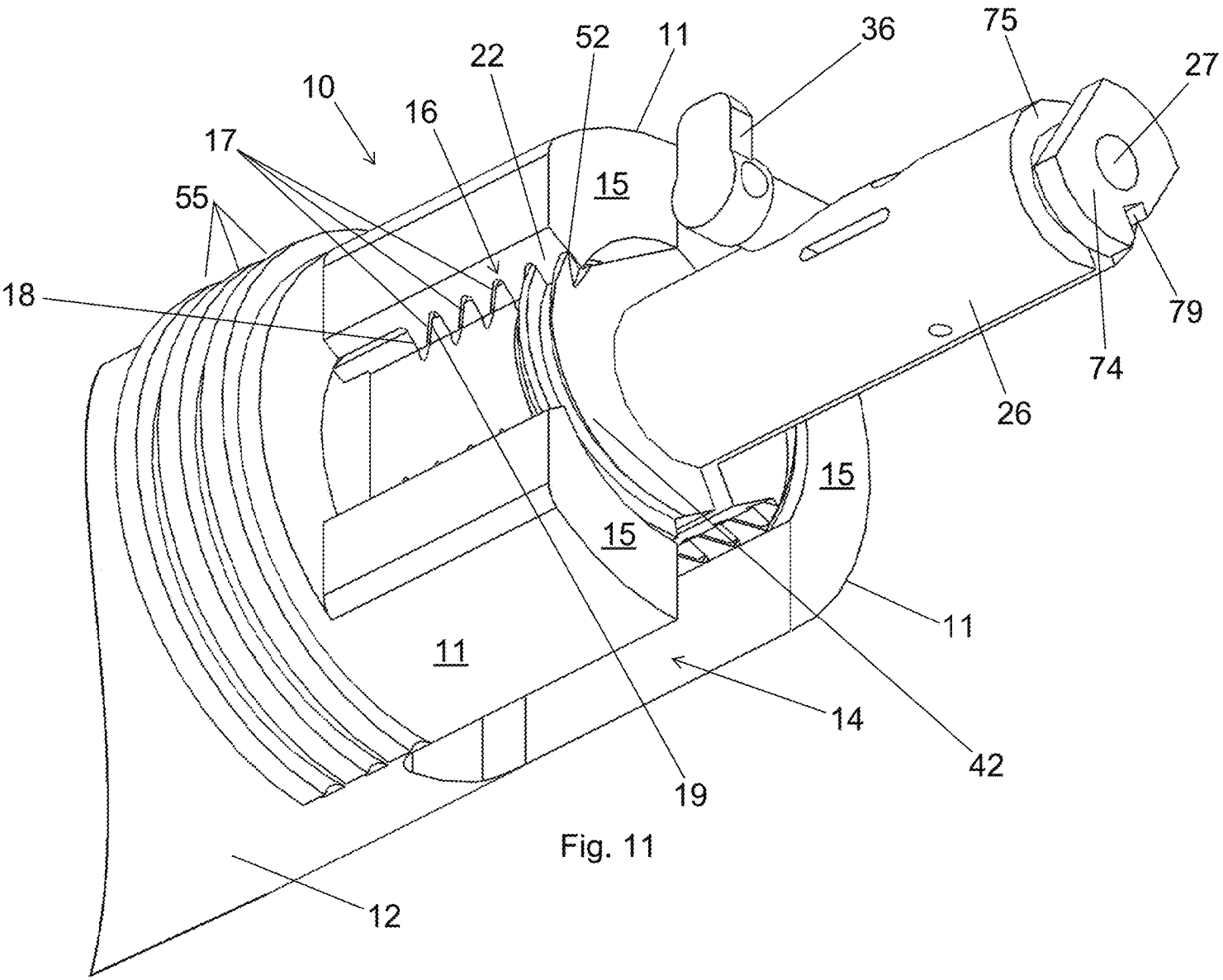
Figure 12:
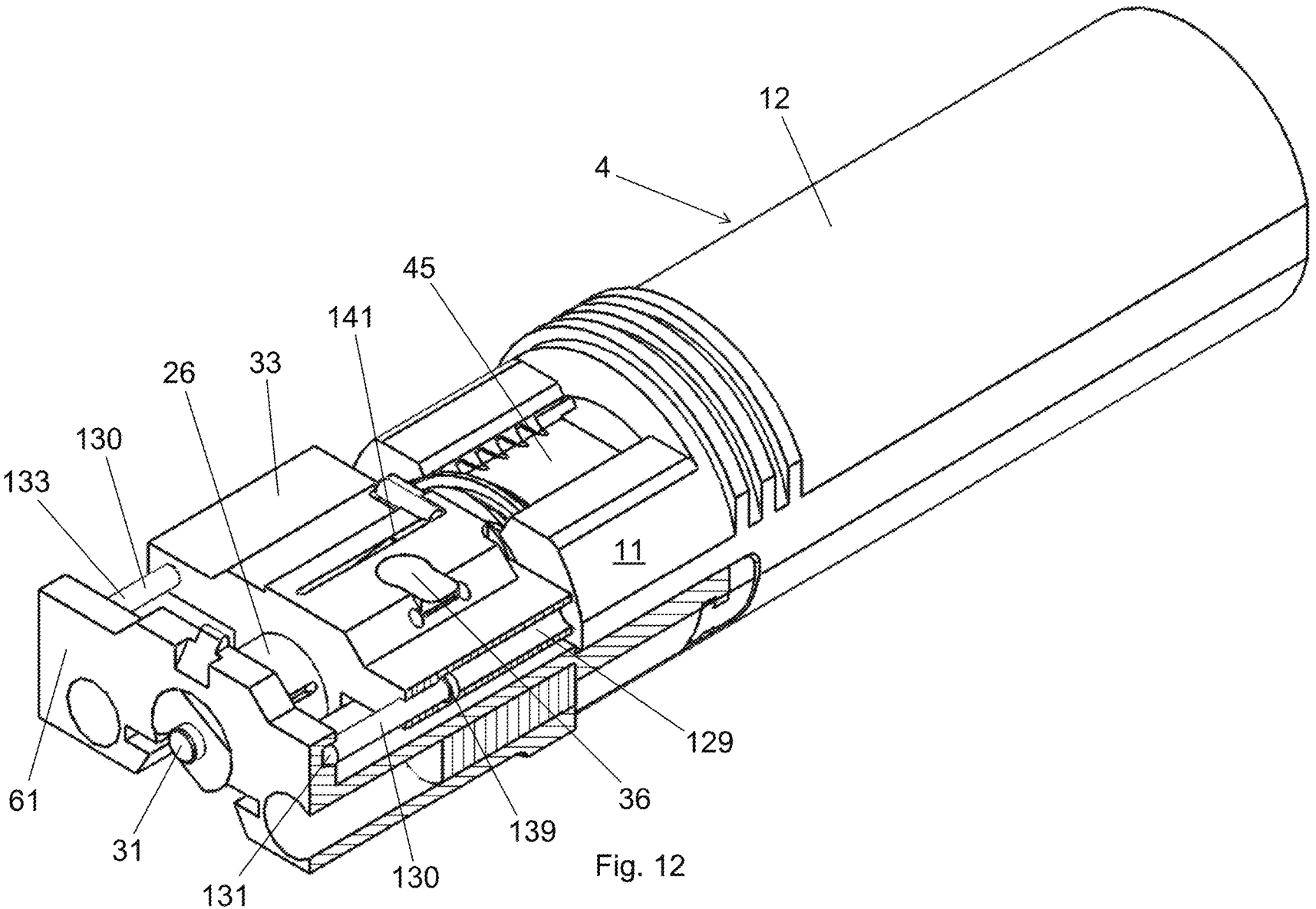
Figure 13:
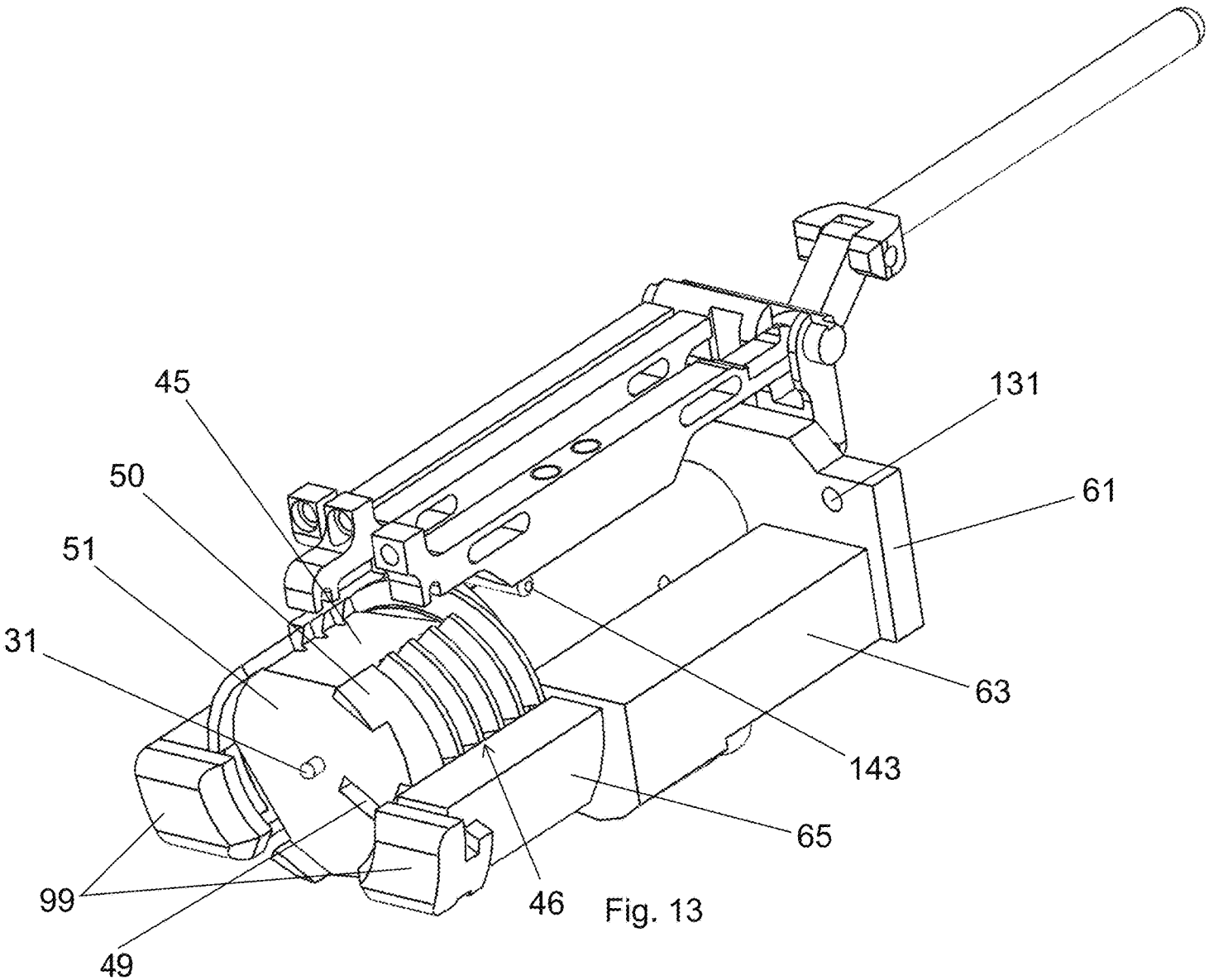
Figure 14:
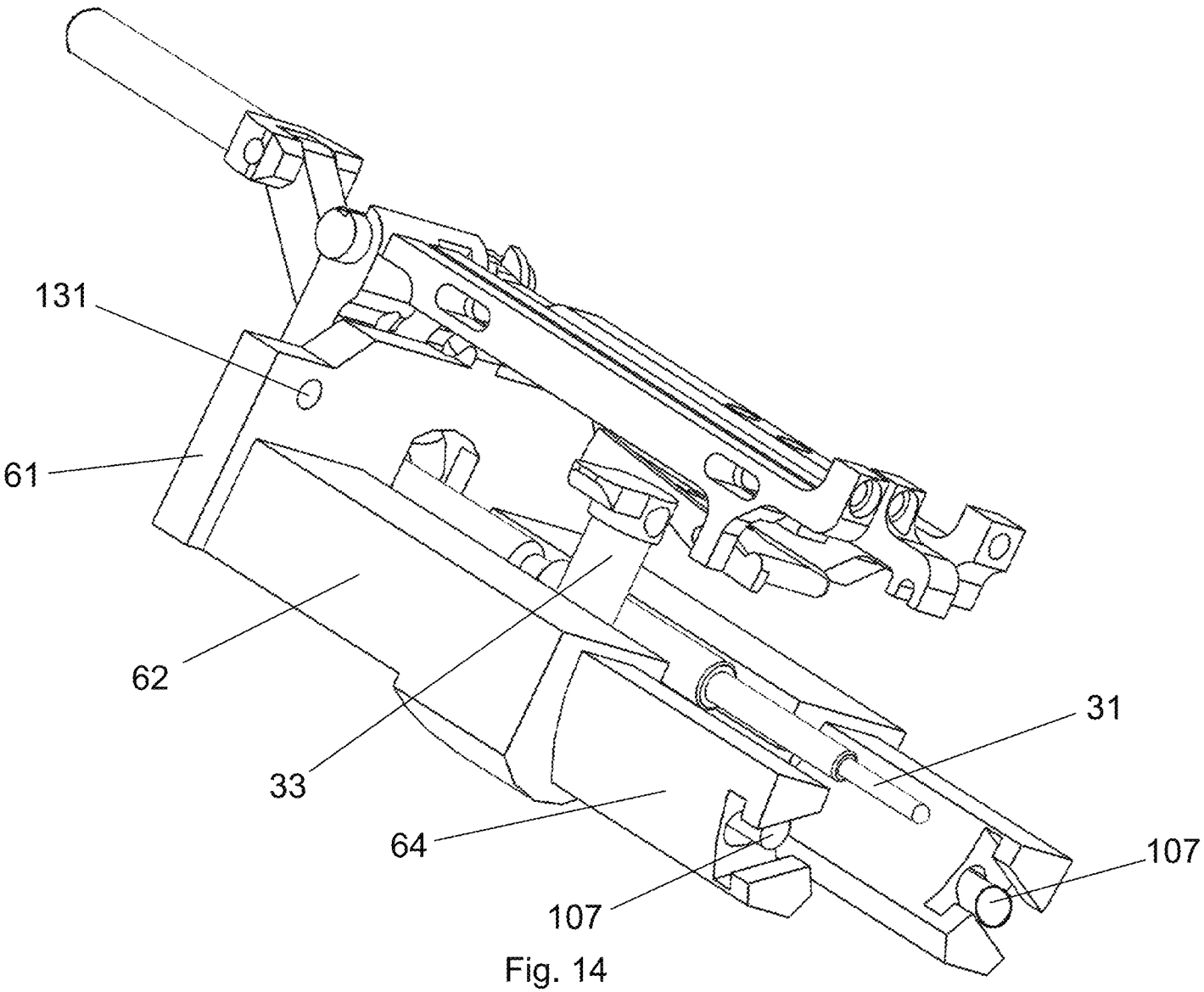
Figure 15:
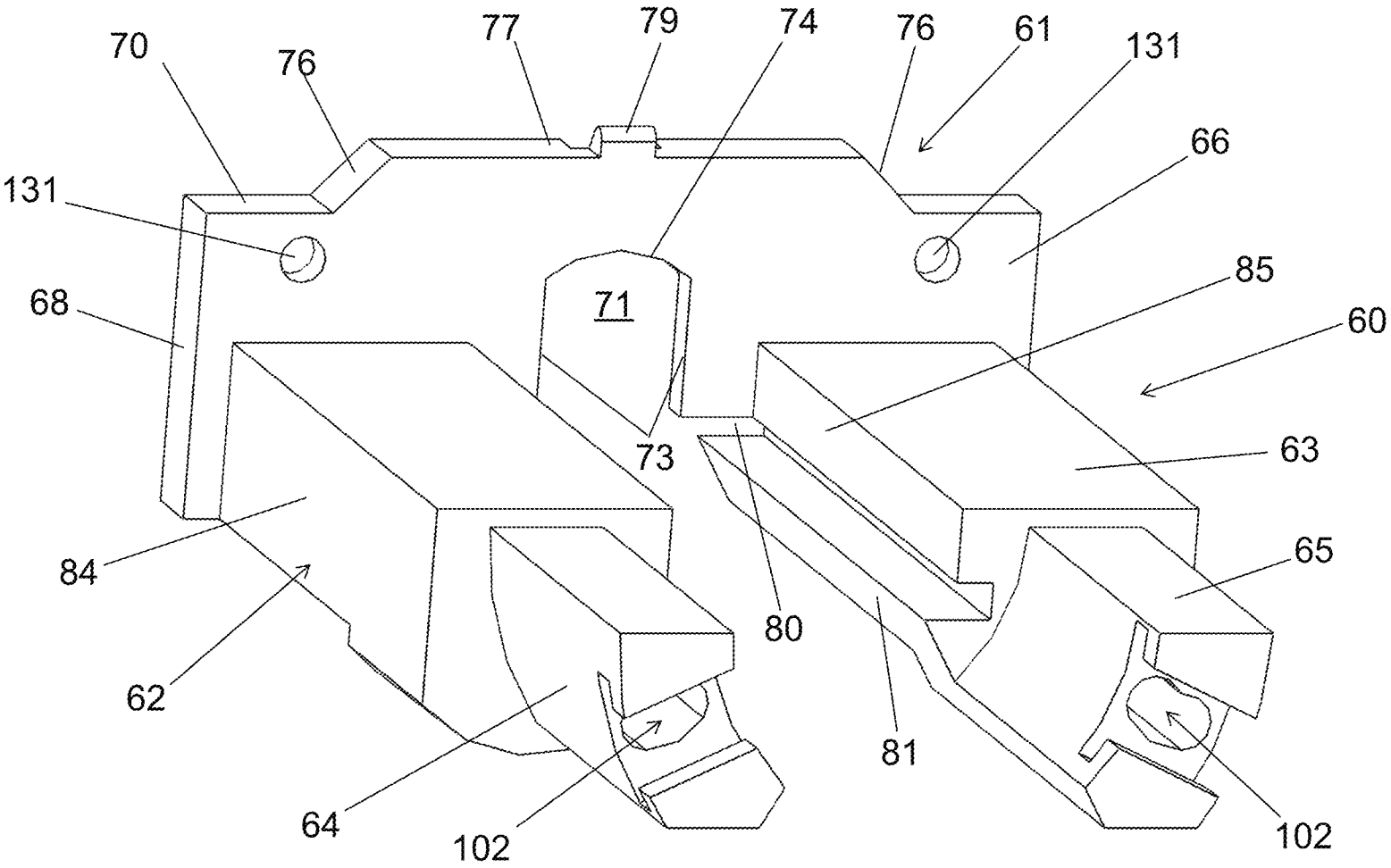
Figure 16:
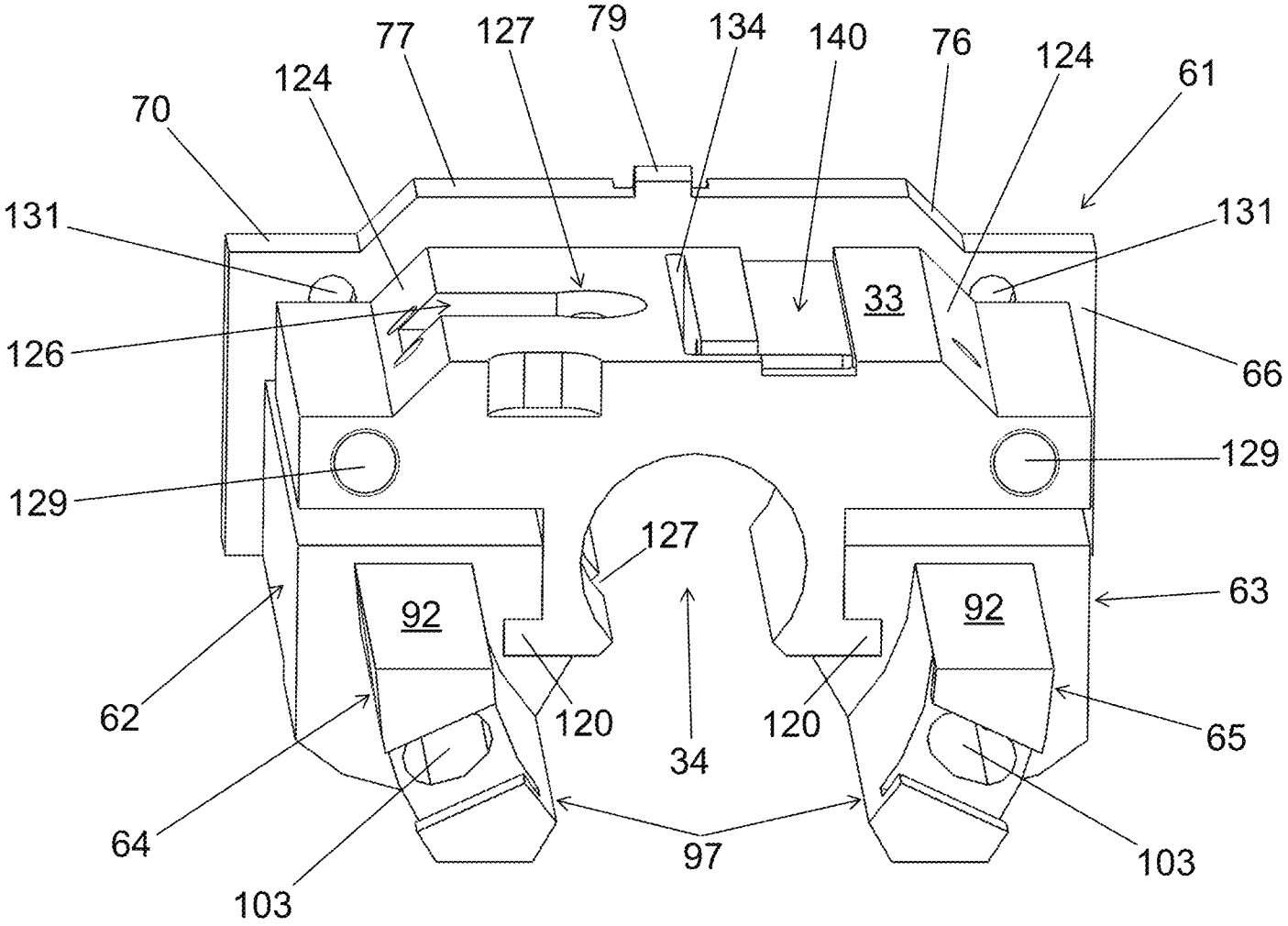
Figure 17:
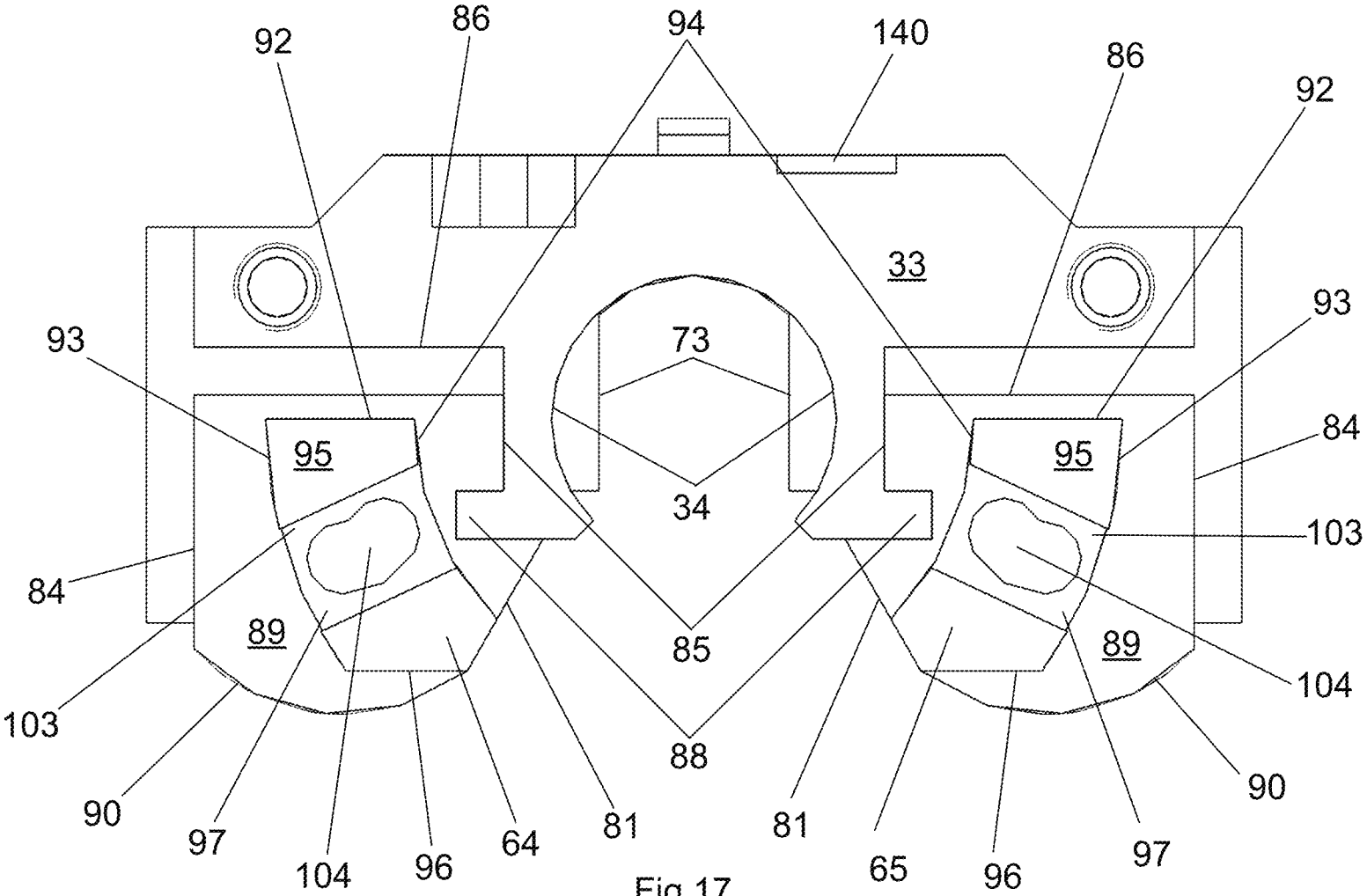
Figure 18:
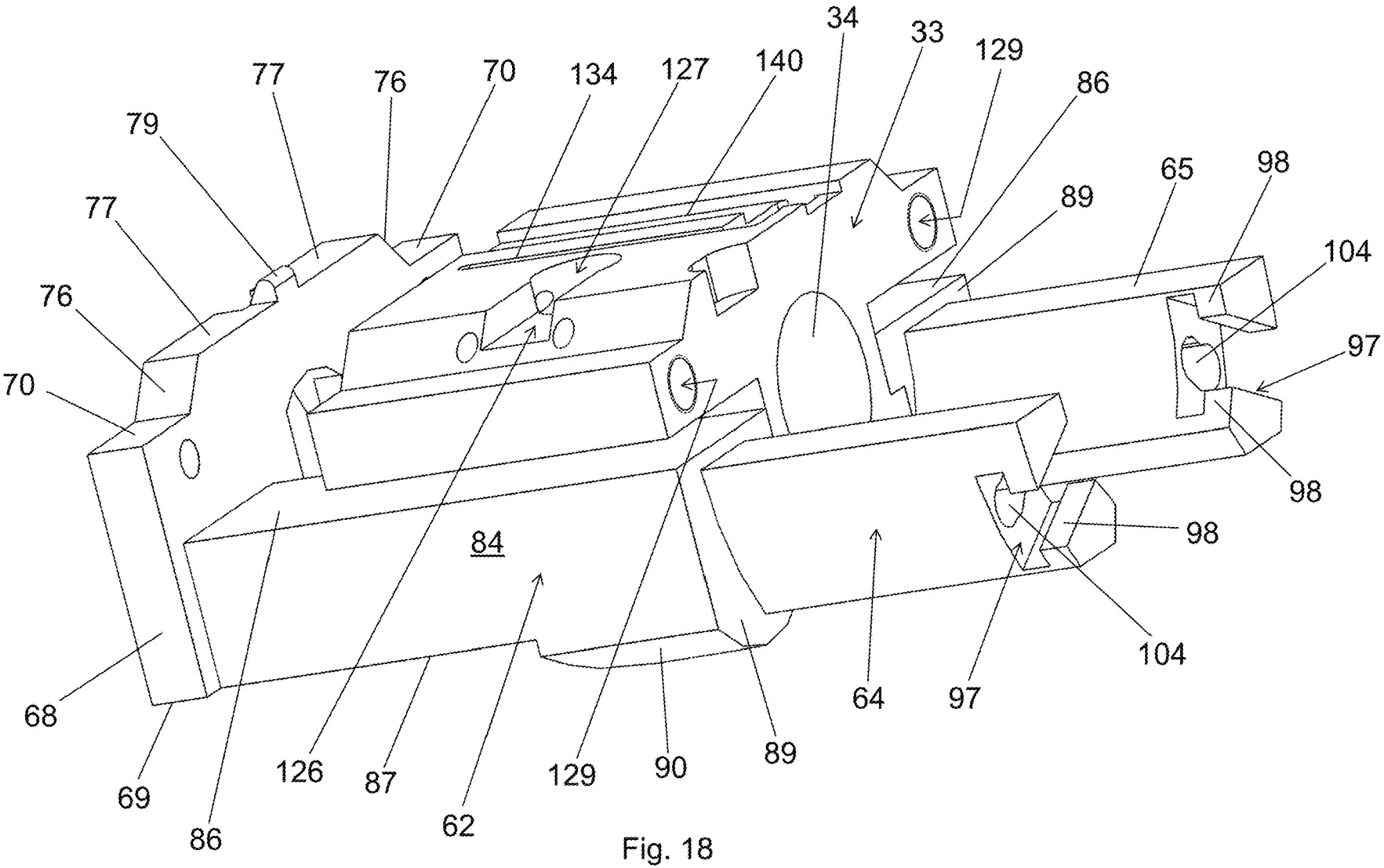
Figure 19:
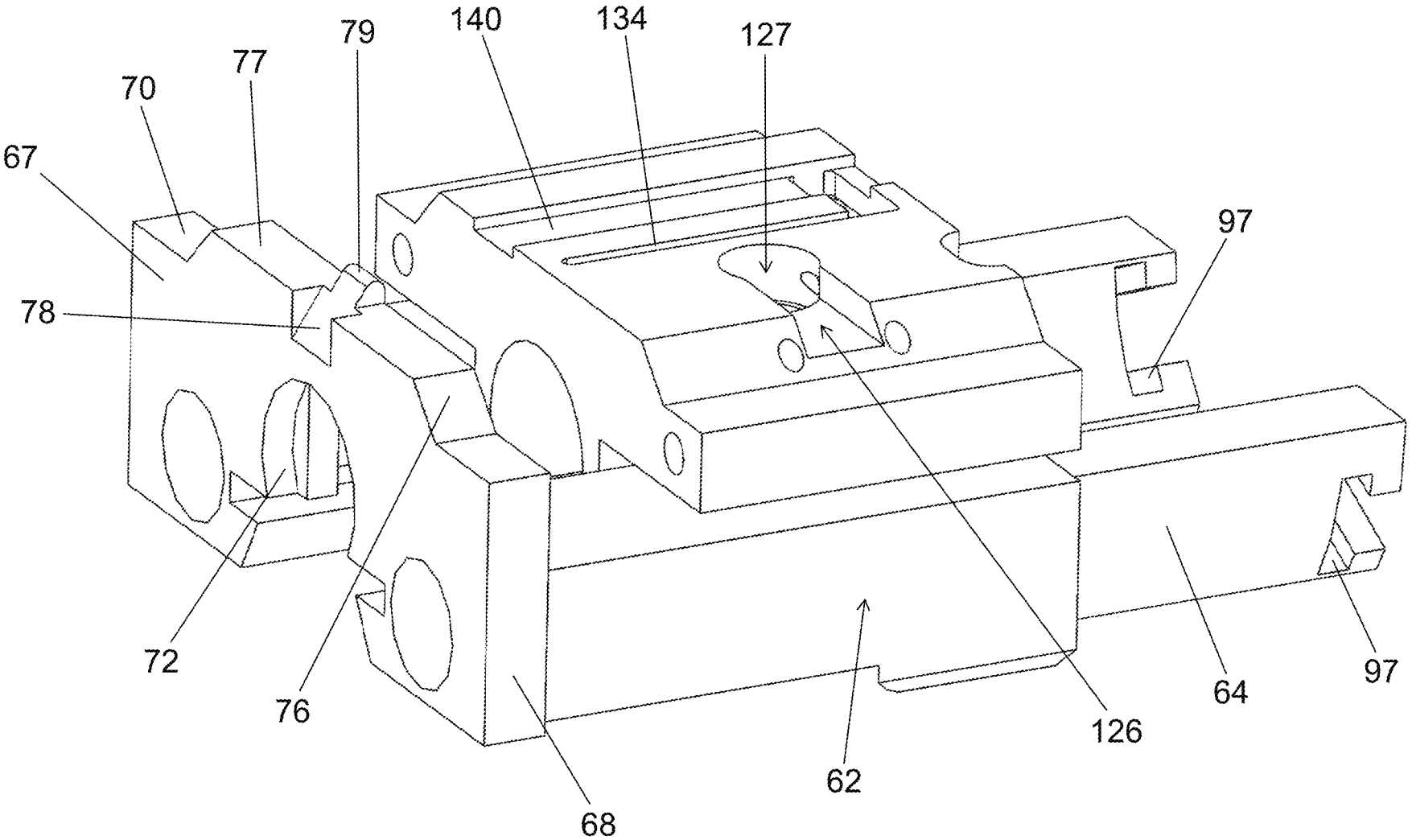
Figure 20:
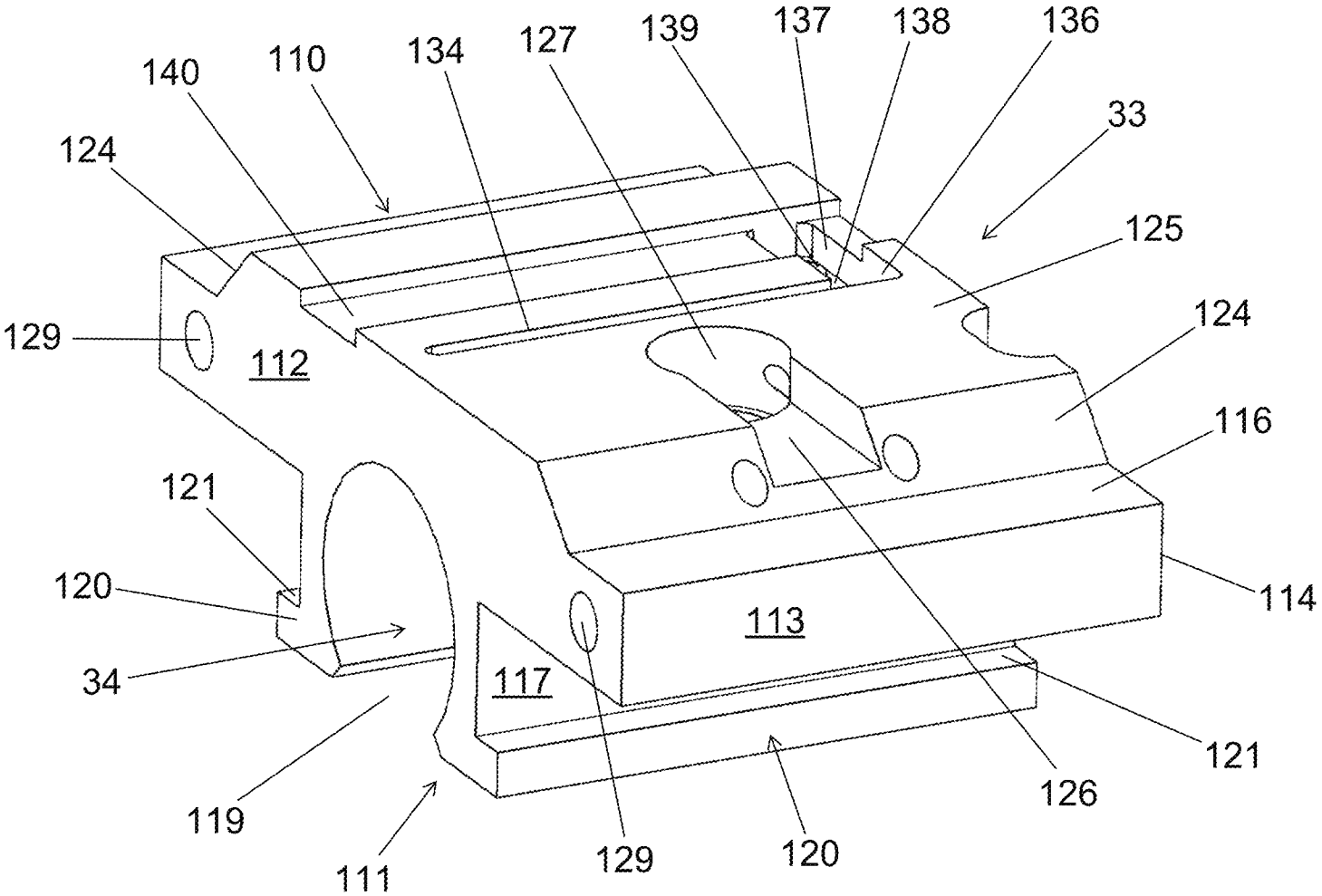
Figure 21:
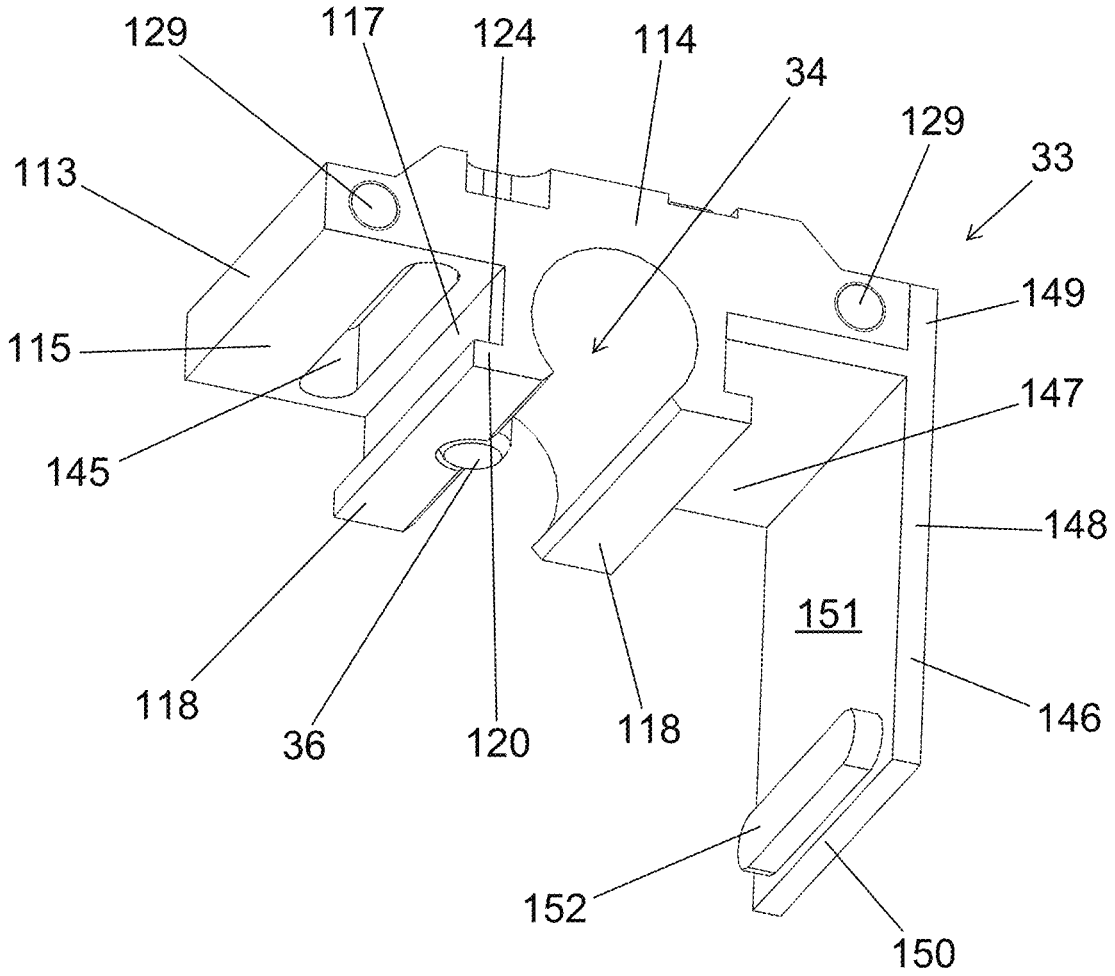
Figure 22:
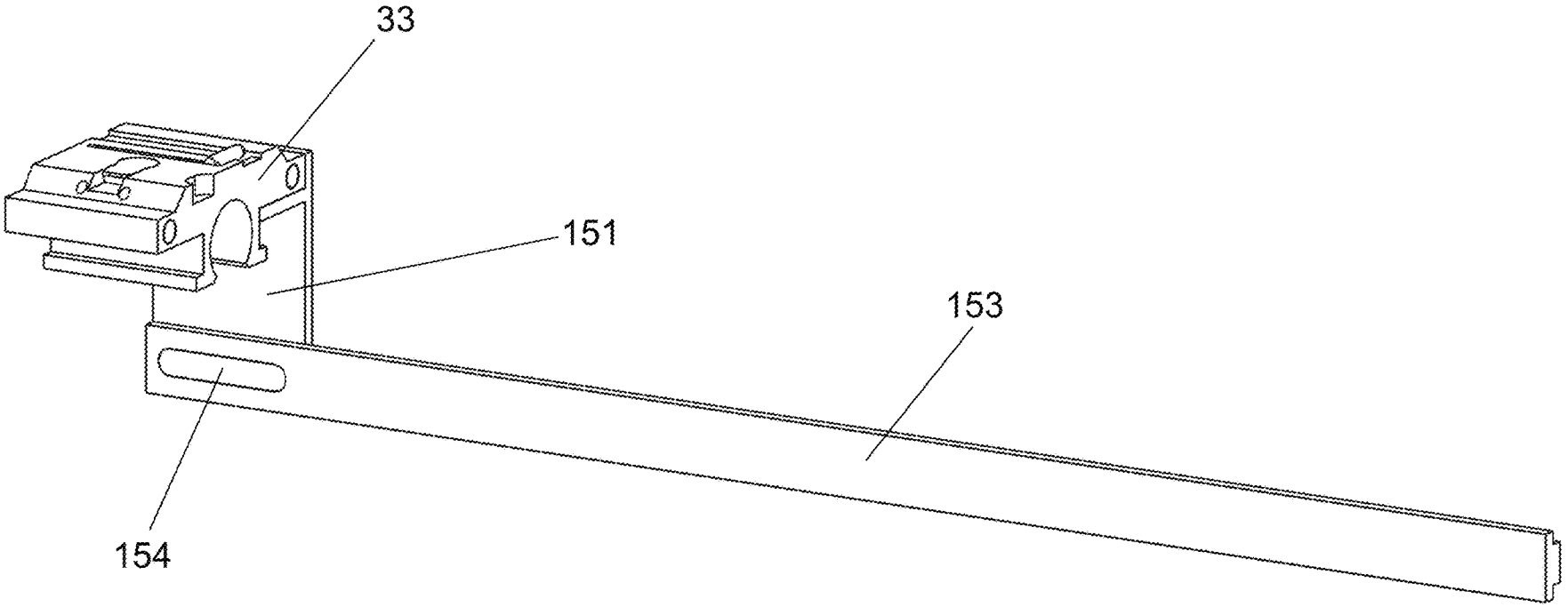
Figure 23:
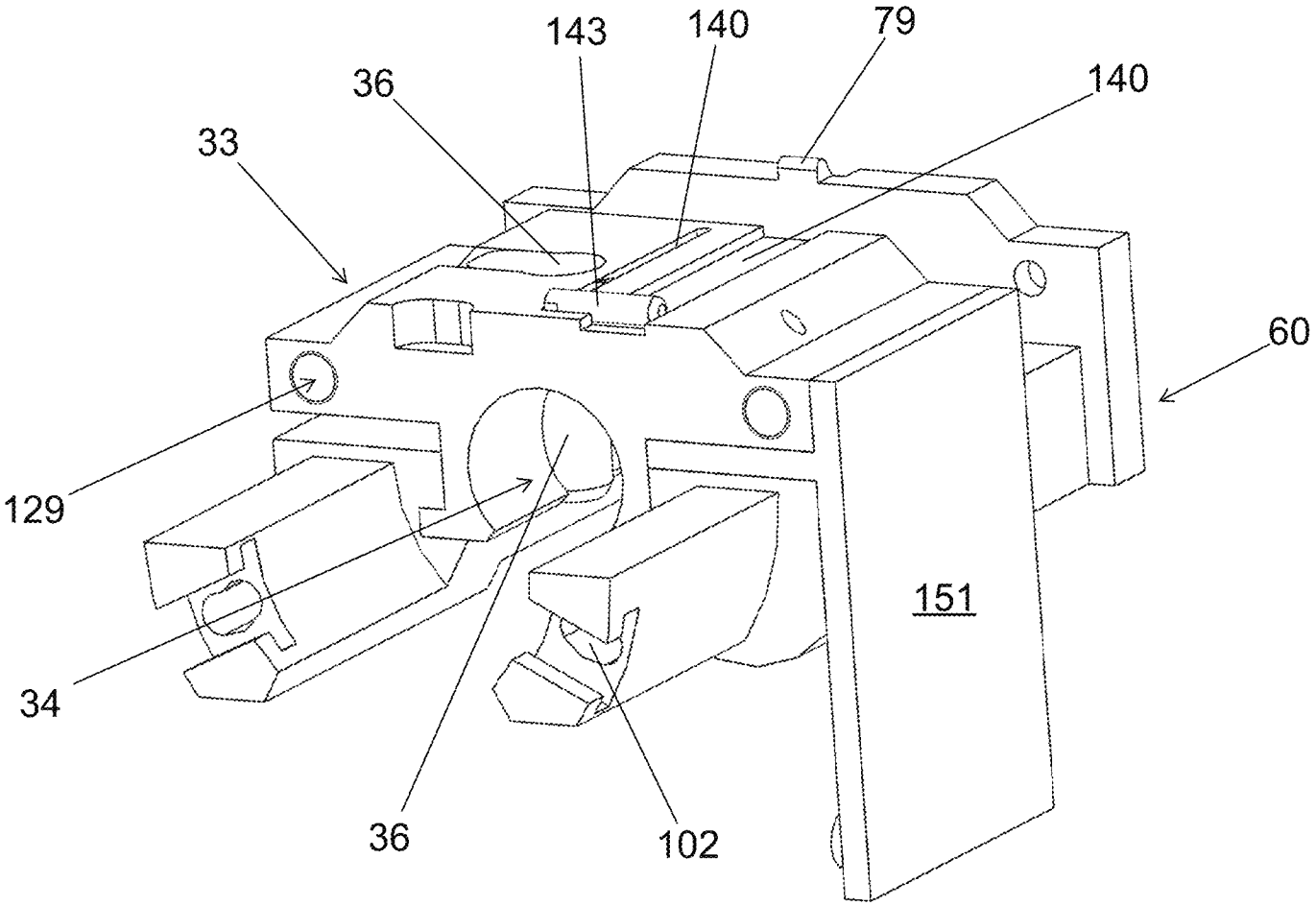
Figure 24:
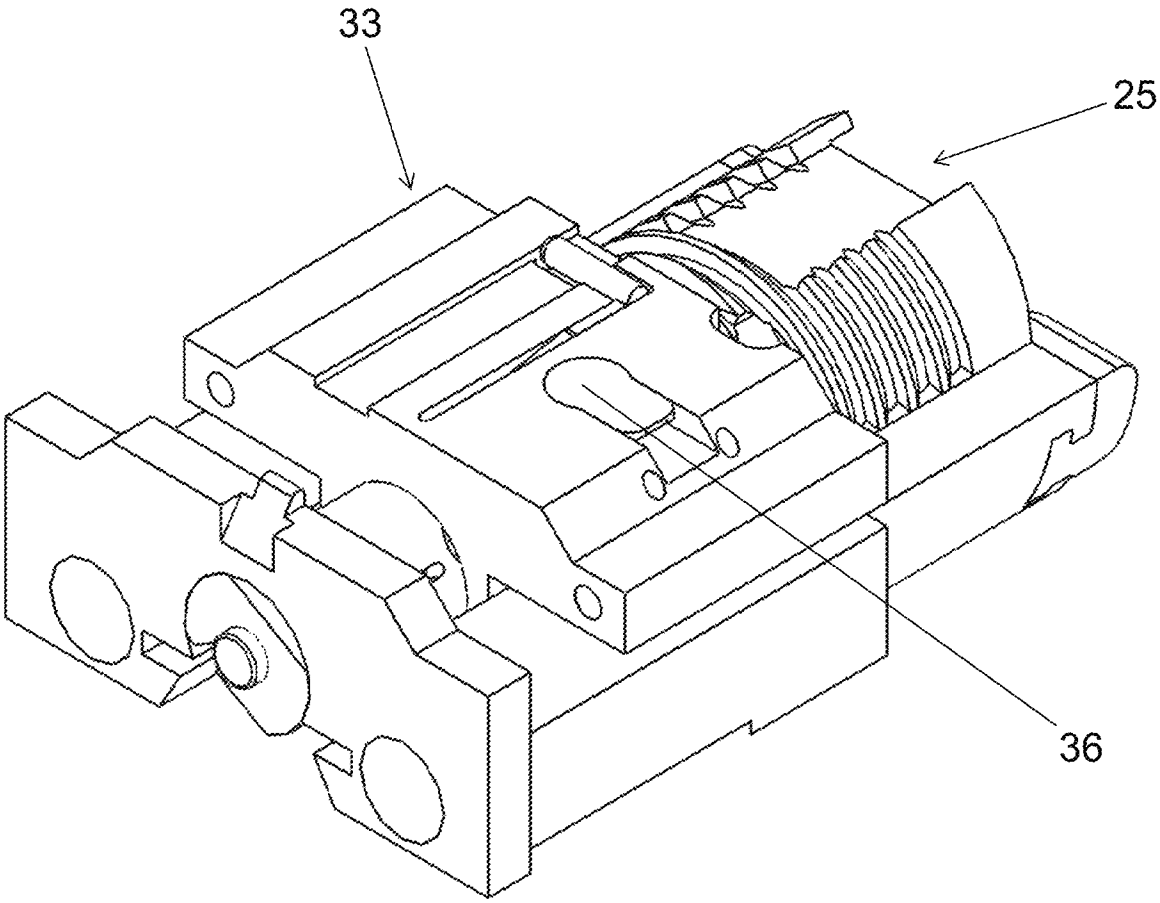
Figure 25:
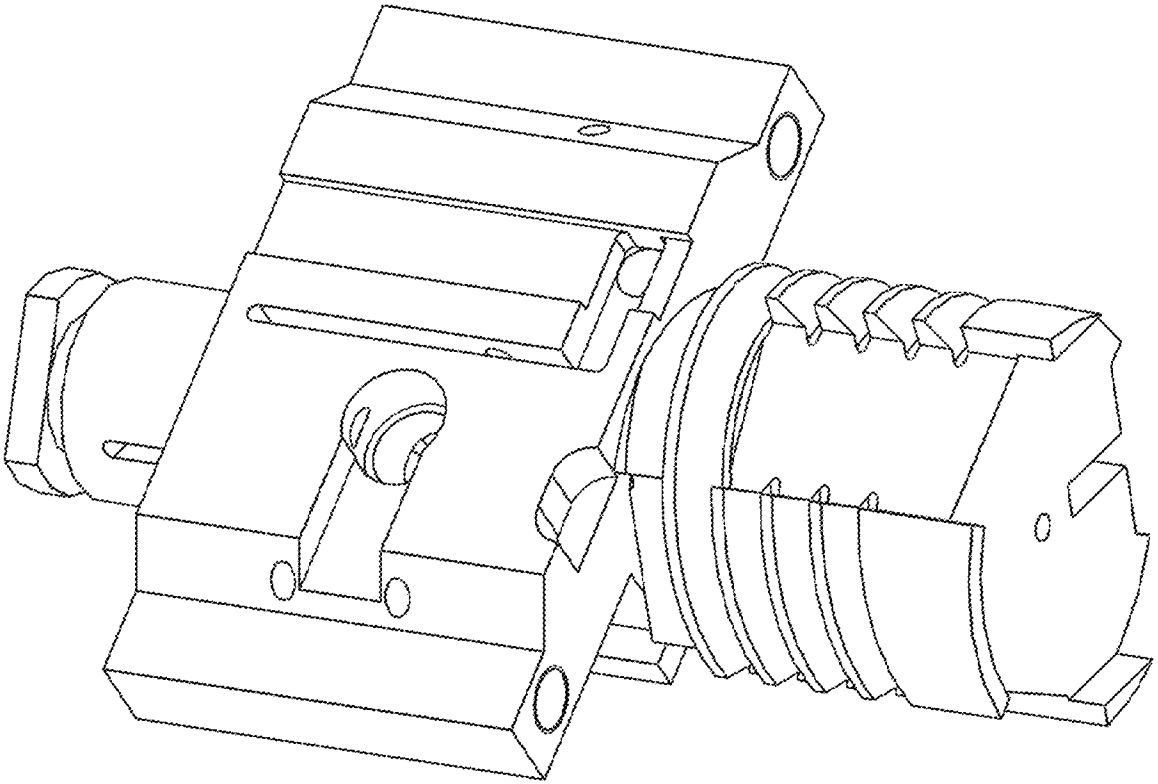
Figure 26:
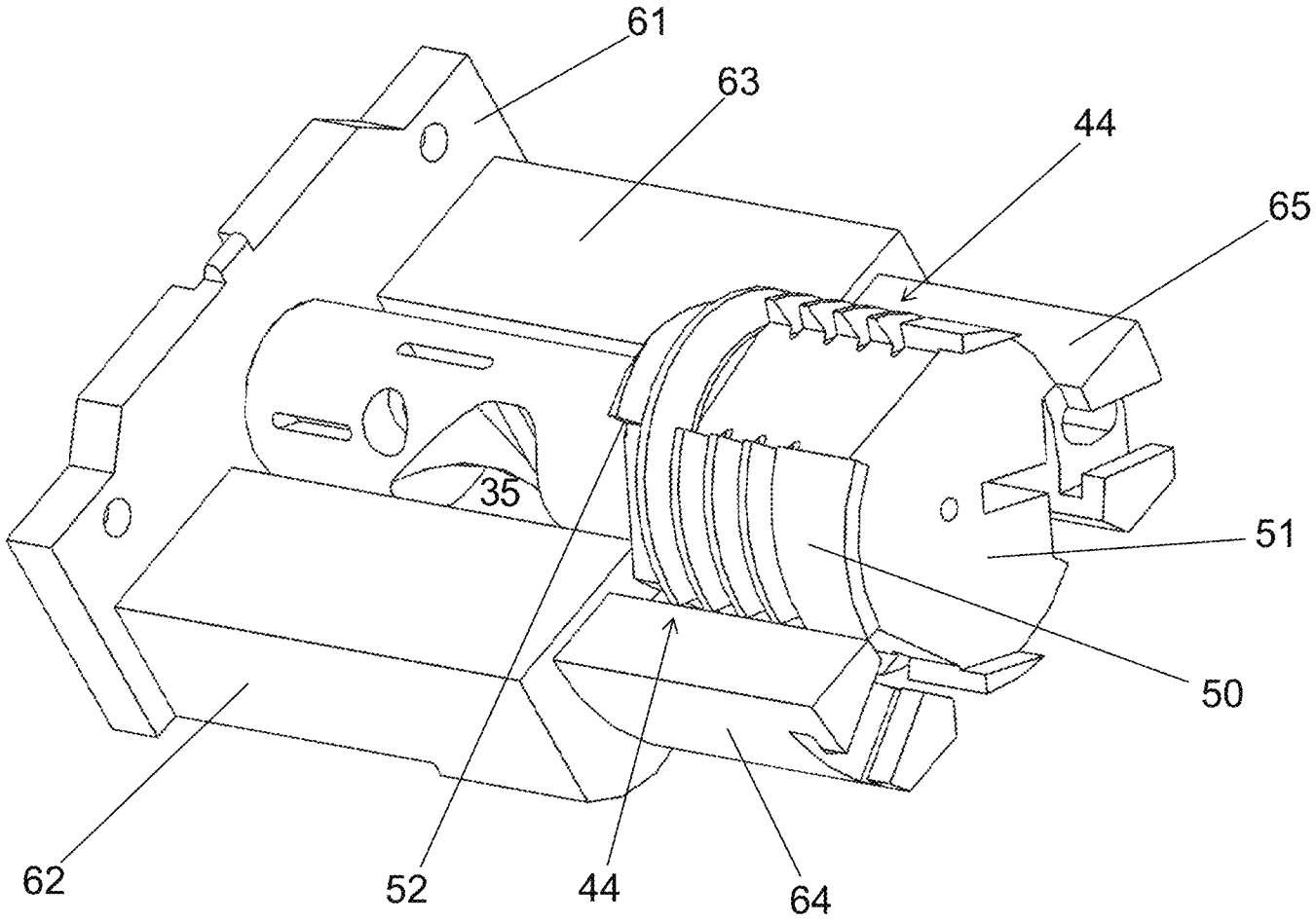
Figure 27:
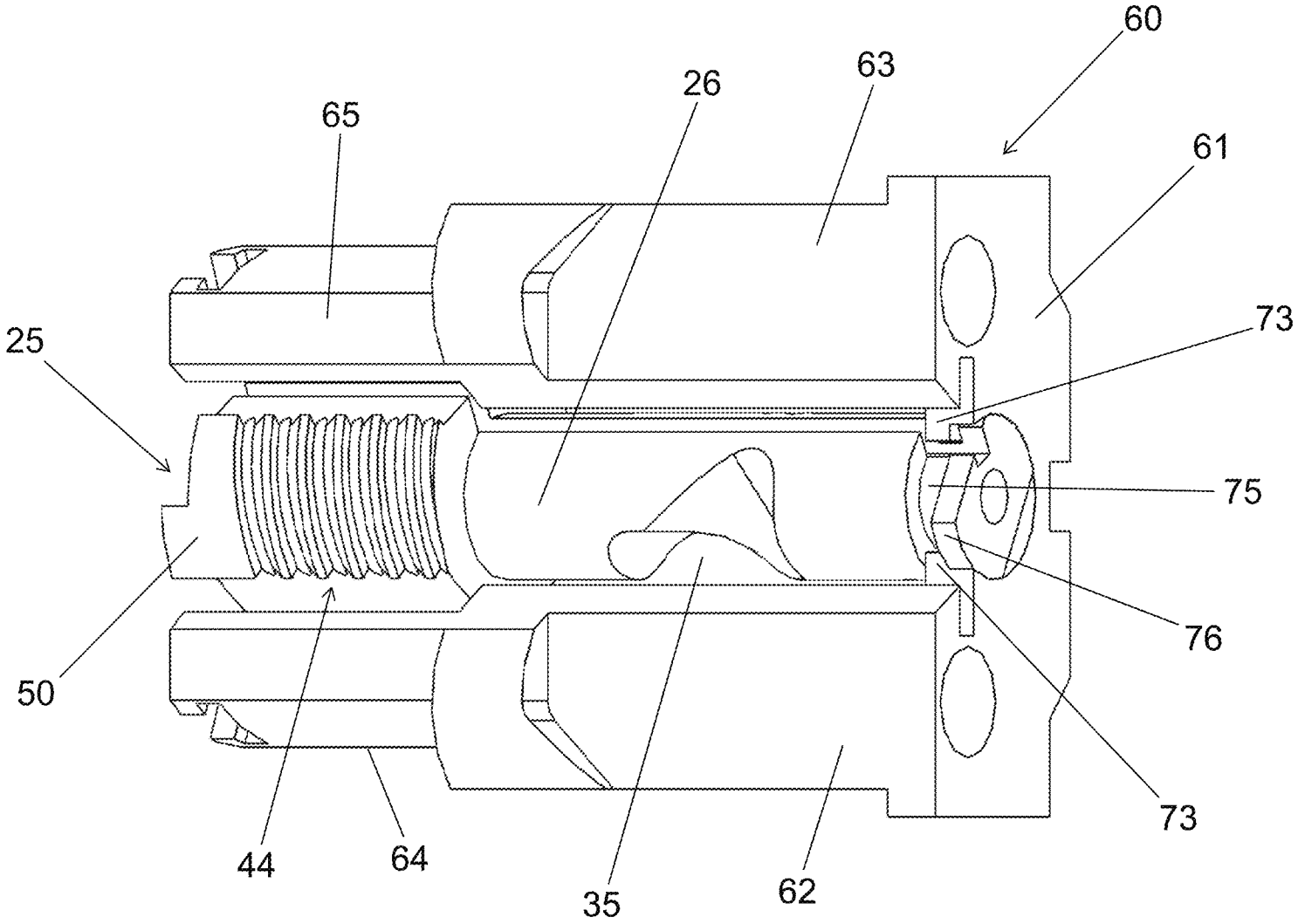
Figure 28:
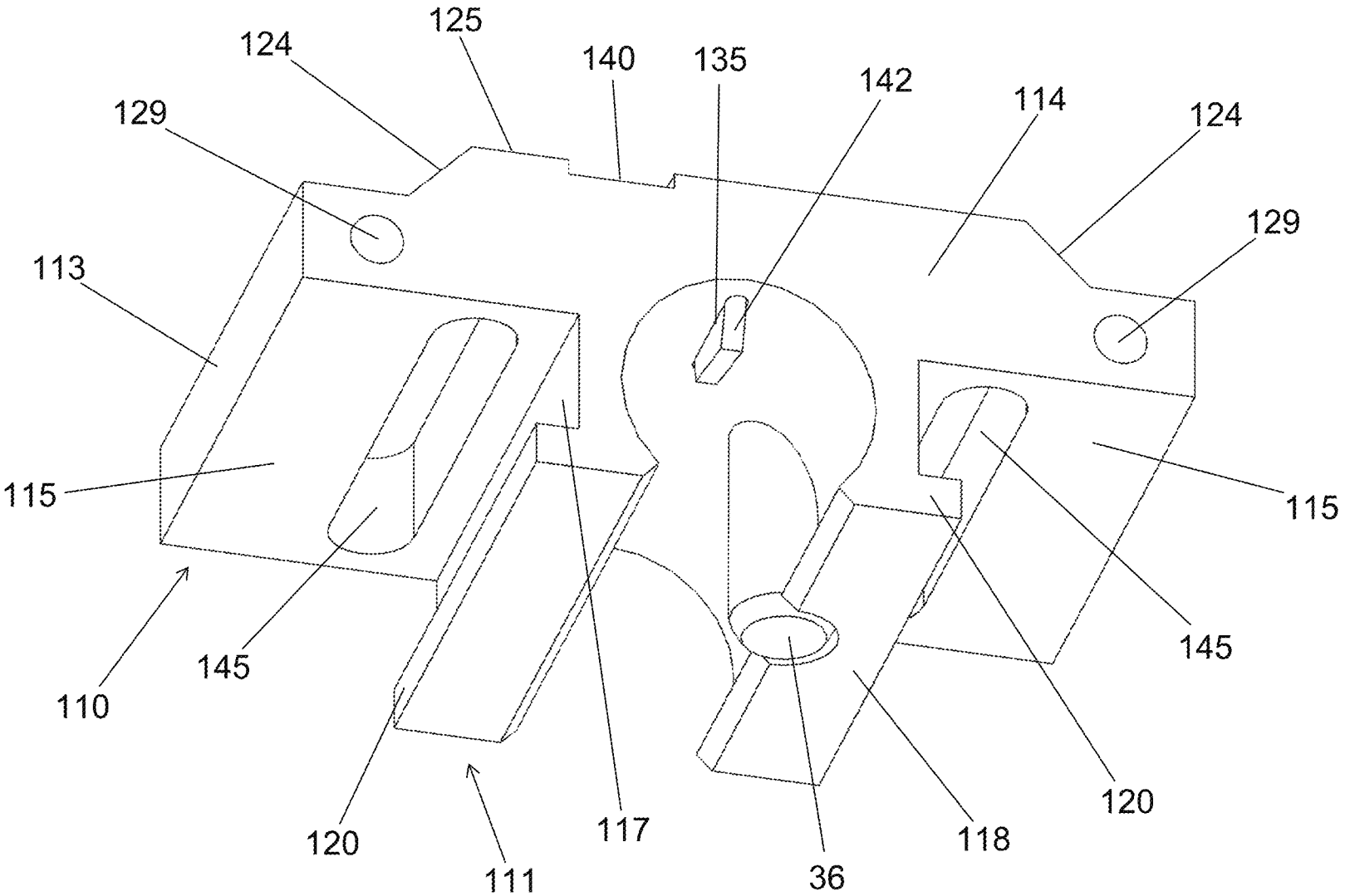
Figure 29:
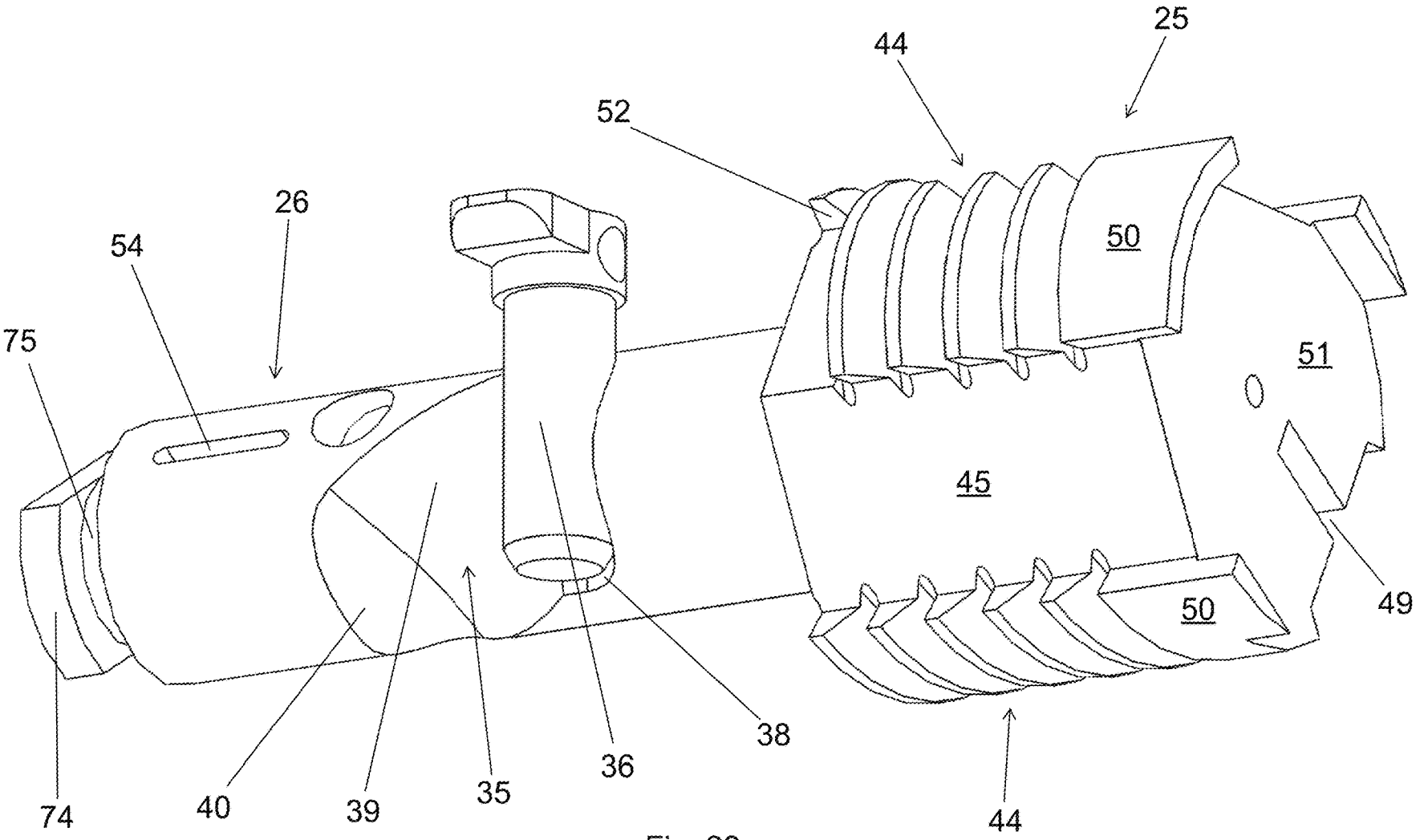
Figure 30:
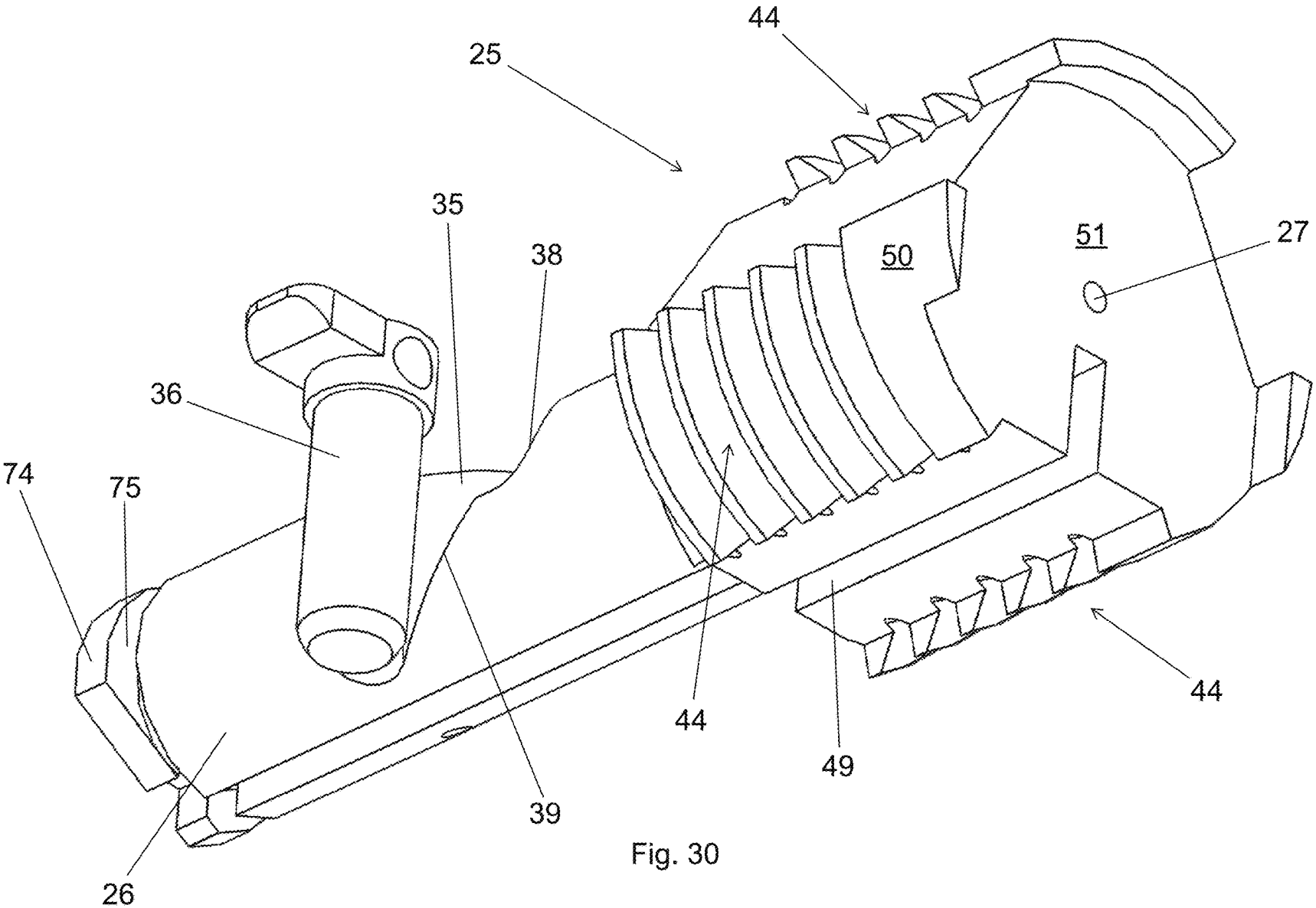
Figure 31:
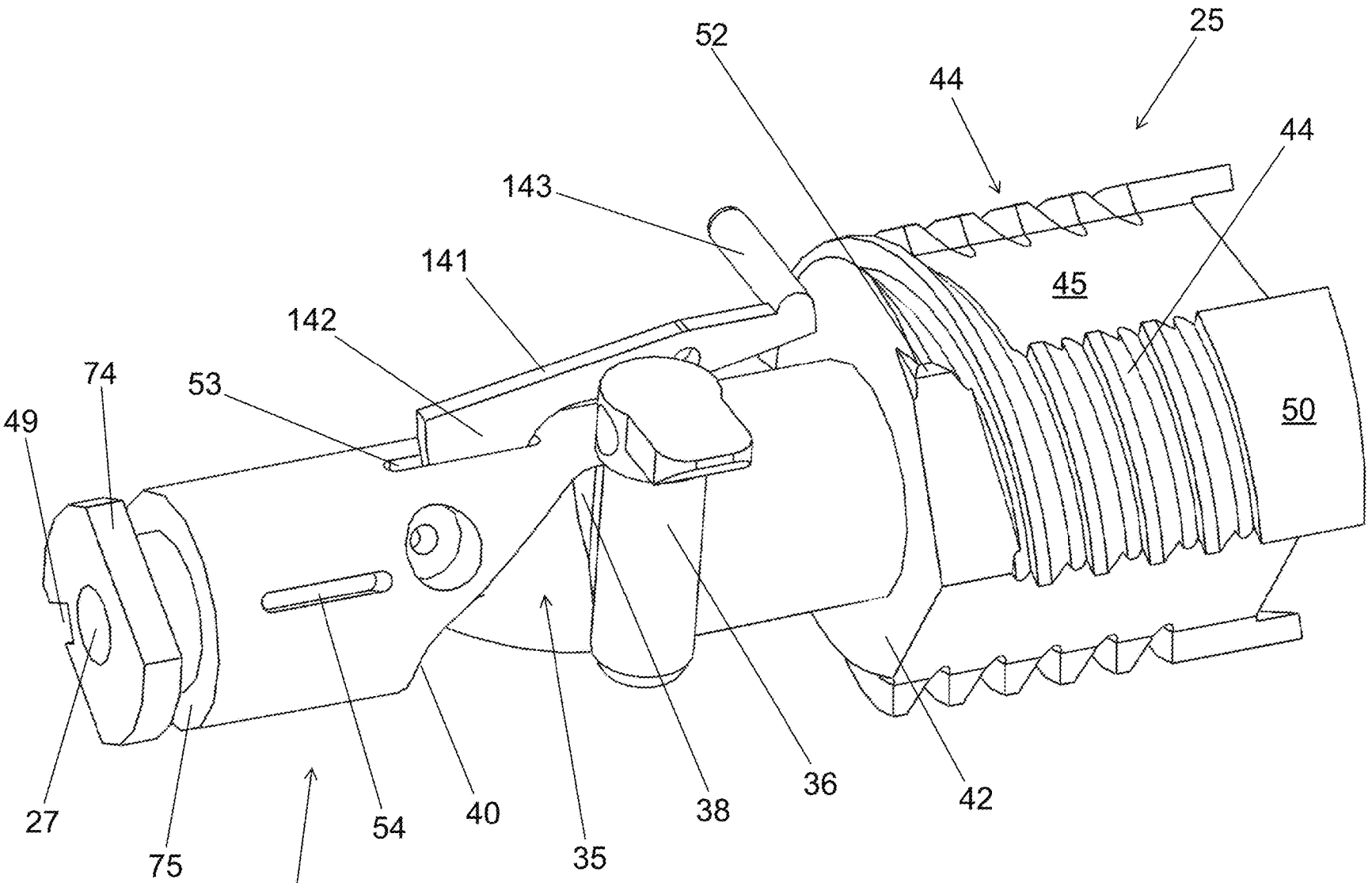
Figure 32:
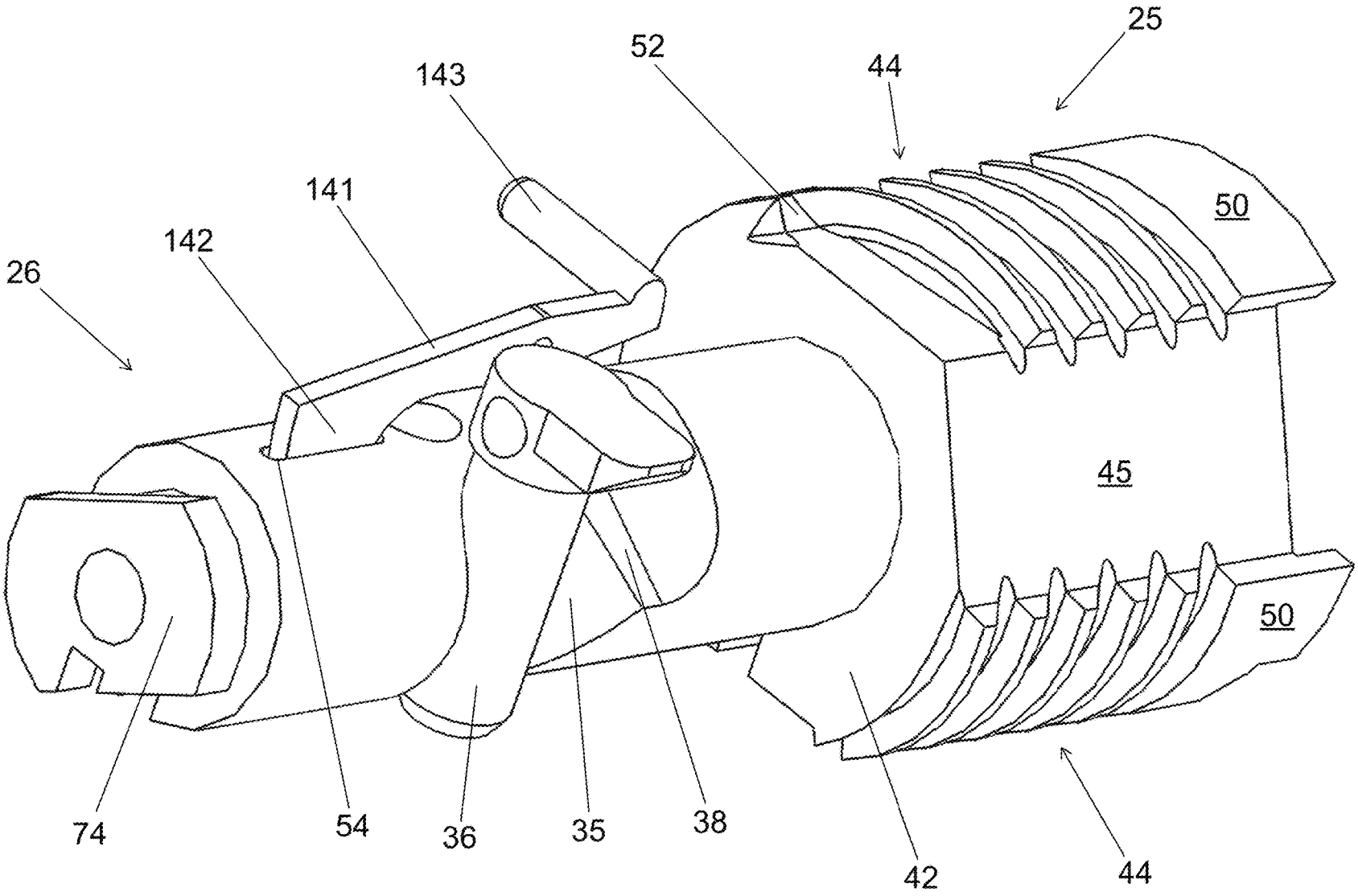

In the drawings:

FIG. 1: shows the breech system according to the invention in a perspective view, showing the bolt head and the bolt receiver;

FIG. 2: shows the breech system according to FIG. 1 from another perspective viewing angle;

FIG. 3: shows the breech system in a view from behind;

FIG. 4: shows the breech system in a side view;

FIG. 5: shows the bolt head and shaft in a perspective view;

FIG. 6: shows another embodiment of a breech according to the invention;

FIG. 7: shows the breech according to FIG. 6 in cooperation with the bolt receiver;

FIG. 8: shows the breech according to the invention and the bolt receiver in a perspective view from below;

FIG. 9: shows a partially sectional, cut-away view of the bolt head and of the bolt head shaft in the bolt receiver;

FIG. 10: shows the arrangement according to FIG. 9 in a perspective view from the opposite side;

FIG. 11: shows the arrangement according to FIG. 9 and FIG. 10 in a different perspective view;

FIG. 12: shows the arrangement according to FIG. 7 in the locked state in a partially sectional view;

FIG. 13: shows a perspective view of a partially cut-away view of the breech according to the invention with the lock of a weapon;

FIG. 14: shows the arrangement according to FIG. 13 in a perspective view of the bolt carrier;

FIG. 15: shows the bolt carrier according to the invention in the second embodiment;

FIG. 16: shows the bolt carrier according to the invention and a bolt body according to the second embodiment;

FIG. 17: shows the arrangement according to FIG. 16 in a view from the front;

FIG. 18: shows the arrangement according to FIG. 17 in a perspective side view;

FIG. 19: shows the arrangement according to FIG. 18 in a perspective view obliquely from behind;

FIG. 20: shows the bolt body according to the invention in the second embodiment;

FIG. 21: shows the bolt body in a perspective view from below with a guide bar positioned on it;

FIG. 22: shows the bolt body with a guide bar positioned on it and a guide rail positioned thereon;

FIG. 23: shows the arrangement according to FIG. 21 in a perspective side view with the bolt carrier;

FIG. 24: shows the entire breech in a perspective view from above and behind;

FIG. 25: shows the bolt head according to the invention, the bolt head shaft, and the bolt body in a perspective view from the front;

FIG. 26: shows the bolt body and the bolt head shaft and the bolt carrier positioned thereon;

FIG. 27: shows the arrangement according to FIG. 26 in a perspective view from below;

FIG. 28: shows the bolt body according to the invention in a perspective view from below with the control pin and the locking pawl;

FIG. 29: shows the bolt head according to the invention and bolt head shaft with the control recess and the control pin positioned therein, in the closed position;

FIG. 30: shows the bolt head according to the invention and the bolt head shaft with the locking pawl according to the invention and the control pin in a perspective view from the side in an open position;

FIG. 31: shows the bolt head according to the invention and the bolt head shaft with the locking pawl according to the invention and the control pin in a perspective view from the side in the closed and locked position; and FIG. 32: shows the arrangement according to FIG. 31 in a perspective view from behind in an open, locked position.

Whenever the "front" is spoken of below in connection with a firearm, this specifically means forward in the direction of fire, i.e. closer when viewed from the muzzle.

Whenever the "rear" or "rearward" is spoken of in the following, this means in the direction away from the direction of fire or farther away from the muzzle.

Whenever "above" or "upper" are spoken of in the following, this means the side of the weapon that is oriented upward in the conventional shooting stance. This is normally the side of a weapon, which, in the conventional shooting stance, has aiming aids such as a rifle scope or sights, or the notch and bead, i.e. the sight line.

Whenever "below" or "lower" are spoken of in the following, in relation to the weapon, this describes the side, which, in the conventional shooting stance, points downward and usually has the pistol grip, the trigger, and the magazine well.

The breech system 1 according to the invention has at least one bolt receiver 2 and a bolt head 3.

The bolt receiver 2 can be positioned in the insertion direction of a cartridge before the cartridge chamber in a barrel for a firearm or can be positioned in a barrel extension 4.

The barrel extension 4 according to the invention is a cylindrical sleeve-shaped component, which has an opening 5 toward the front in the direction of fire and a rear opening 6 toward the rear in the direction of fire. Viewed from the front opening 5, the barrel extension 4 has a thread 7 for screwing in a barrel, which corresponds to a conventional external barrel thread and corresponds thereto. The threaded region 7 can be adjoined by a smooth region 8 away from the direction of fire; the smooth region 8 has a diameter that corresponds to the inner diameter of the thread 7 and thus reduces the inner diameter of the barrel extension 4. This region usually serves to receive the smooth end region of a barrel oriented in the direction of fire. In the direction away from the direction of fire, the smooth region 8 ends with a stop 9 against which a barrel then rests on the cartridge chamber side.

Away from the direction of fire, this is then adjoined by the bolt-locking region 10. The bolt-locking region 10 has three cylinder segments 11 extending rearward, i.e. away from the direction of fire, which extend the circumferential wall 12 of the barrel extension 4 or a barrel on the outside.

For example, the cylinder segments 11 are positioned symmetrically to one another and thus e.g. at an angle of 60° relative to one another. Correspondingly, the cylinder segments 11 radial delimit slots 14 between one another, the slots likewise being correspondingly positioned offset from one another by 60°. The cylinder segments end axially at end walls 15, the end walls 15 preferably being situated at the same axial level.

On the inside of the cylinder segments 11, a thread 16 is provided. The thread 16 is therefore embodied as an internal thread and particularly according to the invention as a buttress thread in which the two flanks 18,19 of a thread comb 17 are embodied with an essentially identically oriented slant such that the respective thread combs 17 appear to be inclined by means of an oblique front flank 18 and an oblique rear flank 19 in terms of in the direction of fire. The respective cylinder segments 11 extend the thread so that without the slots 14, the thread and the thread helix would be continuous. According to FIG. 4, the thread combs 17 in this case are embodied as a cross between a trapezoid and a sharp thread in the form of a sharp thread with flattened tooth crests or thread comb edges.

In direction of fire in front of the thread 16, the cylinder segments 11 have smooth regions 20 of axially different lengths. The smooth regions 20 in this case are embodied as cylinder segment inner walls and viewed axially, are positioned at the height of the thread base so that the threads protrude inward from it. Since the thread 16 is embodied as a thread on the cylinder segments 11 that is broken only by the slots 14, but is otherwise continuous, the regions 20 have axial different lengths.

Correspondingly, the thread combs 17 are also embodied as axially different in the individual cylinder segments 11 so that for example on one cylinder segment 11, the thread combs begin directly in the vicinity of the end wall 15, while in other cylinder segments 11, in particular a cylinder segment 11*a*, adjacent to the end wall 15, there is a smooth region 21 that protrudes radially inward by the same amount as the thread combs 17. This smooth region 21, which protrudes radially inward, forms an axial stop surface 22 in its insertion direction of the thread.

The cylinder segments 11 can be embodied the same in terms of their radial width or arc length, but the cylinder segments 11 can also be of different widths so that the slots 14 in this case are not offset from one another uniformly by 60°, but instead for example two slots 14 are offset from each other by a smaller angle. Correspondingly, the thread combs 17 can be of different lengths depending on the cylinder segment 11.

In addition, the cylinder segments 11 can be embodied without separating slots positioned between them so that the circumferential wall 12 of the barrel extension 4 is embodied as continuous; in this case, however, axial slots 14 are provided in the circumferential wall 12 of the barrel extension 4 in such a way that the threads of the breech, which are described in greater detail below, can slide in these regions.

The bolt 3 has a bolt head 25 and a bolt head shaft 26, which can be embodied of one piece with each other, for example. The bolt head 25 and the bolt head shaft 26 have an axial, continuous bore for accommodating a firing pin and a firing pin spring; at the front, the bolt head forms a breech face 27, which has a through bore 29 for a firing pin tip 30 in the center.

In addition, the bolt 3 has a bolt body 33, which surrounds the bolt head shaft 26 and thus has a central bore 34 in which the bolt head shaft is supported in rotary fashion. The bolt body 33 is supported in non-rotating fashion in a sleeve or chassis of the weapon so that a rotation between the bolt head shaft 26 and bolt body 33 can only be executed by the bolt head shaft 26 in the bolt body 33.

In order to ensure a defined rotation, a control cam is provided in an intrinsically known fashion in the bolt head shaft 26 as a control surface of a lateral control recess 35 (FIG. 5, 29-32). A control pin 36 extends through the control recess 35 and is positioned axially on the bolt head shaft 26, resting against the control surface 35 in the bolt body 33, or cooperates with it.

At its axial front end, the control recess 35 has an initially axially extending region 38, which has an axial length that corresponds at least to the diameter of the control pin 36 and then transitions into an oblique region 39, which is inclined relative to the longitudinal axis, until it reaches an axially rear stop region 40.

The inclination of the control recess 35 in the oblique region 39 is embodied so that a sliding of the bolt body 33 axially toward the front results in the fact that the control pin 36 travels out of the axial region 38 of the control recess 35 and is moved through the oblique region, sliding along it, and as a result, a rotation in the direction of fire occurs, toward the right in the instance shown.

The radial path length of the control pin 36 in the control recess 35, i.e. from an axial region 38 to the rear axial stop region 40 in this case, is selected so that it essentially corresponds to the radial depth to which the thread 16 of the cylinder segments 11 is screwed in.

This means that the radial length and movement of the control pin 36 corresponds to 60° when there are three symmetrical cylinder segments 11, corresponds to 90° when there are two cylinder segments 11, and would correspond to 45° if there were four cylinder segments 11. The axial length of the control recess 35 is selected so that only a reasonable amount of effort is required for the rotation on the one hand and on the other, the bolt repeating path is only prolonged to a minimal degree. In this case, in the open state of the breech system, a front edge 41 of the bolt body 33 is spaced apart from a rear edge 42 of the bolt head 25 by approximately the axial length of the control recess 35 and after the control pin has traveled out of the axial region 38 via the control recess 35 and its oblique region into the axially rear stop region, is preferably still spaced slightly apart from the bolt head 25.

The control recess 35 and control pin 36 can also be positioned on the components of the bolt head shaft 26 and bolt body 33 in the opposite way so that the control recess 35 is provided in the bolt head shaft 26 and the control pin 36 is provided in the bolt body 33. The essential thing is that by means of a control pin 36 and a control recess 35, a defined rotation of the bolt head or more precisely, of the bolt head shaft 26 in the bolt body 33 is assured.

In order to produce a twist-lock connection between the bolt head 25 and the bolt receiver 2, the bolt head 25 has thread segments 44 that correspond to the threads 16 or thread combs 17 of the cylinder segments 11. The thread segments 44 are thus embodied as external threads; between the thread segments 44 in a manner corresponding to the threads 16, flutes 45 are provided, whose flute bottoms reach to the thread bases between the thread combs 46 or extend even deeper than them. The individual thread combs 46 each have a front flank 47 and rear flank 48. The front flank and rear flank can be inclined according to the invention and in their inclination, can correspond to the inclination of the front flank 19 and rear flank 18 of the threads 17 cylinder segments 11.

This means that when the bolt head 25 is being pulled out of the barrel receptacle 2, the individual thread combs 17, 46 are pulled into one another because of the oblique planes.

In the region of a flute 45, the bolt head 25 and the bolt head shaft 26 have a continuous axial groove 49 for a cartridge ejector (not shown), which, when a cartridge is pulled out of the cartridge chamber with the aid of the bolt head 25 as the bolt 3 is drawn back, plunges into the groove 49, reaching to the breech face, and in it, presses against the cartridge bottom in a known way and thus conveys the cartridge out of the ejection window of a weapon.

Alternatively, the cartridge case can be ejected by a springy ejector that is built directly into the breech face 51 of the bolt head 25.

The thread combs 46 of the thread segments 44 of the bolt head 25 correspond to a thread helix that is continuous, but is interrupted by the flutes 45; on a thread segment 44 of the bolt head 25, one or two threads adjacent to a rear edge 42 of the bolt head 25 protrude into a flute 45 ahead of it in the rotation direction and form a stop surface 52 in order, in cooperation with a stop surface 22 of the bolt receiver 2, to form a radial screw-in stop.

In particular, several threads are superposed both on the bolt head 25 and on the bolt receiver 2 so that a multiple-start thread helix is formed.

For example, three threads are superposed so that a triple-start thread helix is formed.

Since the thread segments 44 and the thread 16 of the bolt receiver 2 are part of a single-start or multiple-start thread helix, they are embodied differently on the individual thread segments so that adjacent to a breech face 51 smooth regions 50 are formed, which on the one hand, protrude beyond the breech face 51 and thus guide the cartridge radially and on the other hand, correspond in their respective axial and radial size to the smooth regions 21 and rest against them in the closed state of the breech.

The flute bottoms of the flutes 45 can be embodied as flat or can be embodied as curved in accordance with the cylindrical curvature of the bolt head.

To begin with, the general cooperation of the bolt head 25 and the bolt-locking region 10 according to the embodiment in FIGS. 1 to 4 will be explained below. The bolt 3 is slid with the bolt body 33, the bolt head shaft 26 therein, and the bolt head 25 in the direction of the locking region 10. As a result of this, the flutes 45 of the bolt head 25 travel into the region of the cylinder segments 11 and the thread segments 44 of the bolt head 25 travel into the region of the slots 14 between the cylinder segments 11.

The slots 14 on the one hand and the flutes 45 on the other are dimensioned so that starting from this time, the bolt head 25 is guided axially and an axial pushing movement between the bolt-locking region 10 and the bolt head 25 is enabled. The axial insertion is possible until the from flank 47 of the thread comb or of the front thread comb, which protrudes into a flute 45, rests against an end wall 15. This blocks a purely axial motion of the bolt head 25 in the bolt-locking region 10. Through this blocking action, the control pin 36 in or on the control recess 35 is slid axially forward, as a result of which the control pin 36 rotates the bolt head shaft 26 corresponding to its sliding action along the control recess 35. Due to this rotation, the thread combs 46 of the thread segments 25 then travel between the thread combs 17 of the thread 16 so that a screwing-in thread engagement of all of the thread combs 16, 17 takes place simultaneously.

After a corresponding rotation by 60° (when there are three cylinder segments 11 and three thread segments 44), a radially front edge 52 of the thread comb 51 or of several thread combs protruding into the flute 45 comes into contact with the stop surface 22 so that the radial movement is stopped. In this state, the bolt head 25 is screwed-in in the bolt-locking region 10 in a locking fashion and an exclusively axial movement of the control pin 35 into the axial region 38 of the control recess 35 is preferably then still possible. This additional axial movement of the control pin 36 into the axial region 38 of the control recess 35 produces a kind of radial immobilization of the bolt head because due to the fact that the bolt body 33 is supported in a rotationally fixed manner in a sleeve or on a chassis of the firearm, the engagement of the control pin 36 in the axial region 38 then causes the bolt head to also be immobilized in a rotationally fixed manner in a first way so that without an active pulling-back of the bolt body 33, it is not possible for the bolt head 25 to rotate out of the bolt-locking region 10.

Usually, the bolt body 33 is also acted on by at least one compression spring, which is supported between the bolt body 33 and a bolt carrier 60 so that the control pin is pushed by a spring force into the axial region 38. This will be explained in greater detail at a later point.

This spring force preferably acts only in the region of the axial movement of the bolt head 25 inside the bolt receiver 2, i.e. as long as the threads 16, 44 are positioned in the slots 14 and flutes 45. As a result, the spring helps the threads 16, 44 "find" each other and screw into each other. In the axial movement range of the bolt head, in which it is rotated all the way into its unlocked rotation position outside of the bolt receiver, the rotary motion of the bolt head shaft 26 is blocked by an active, controlled locking pawl 141, which can engage in locking slits 53, 54 in the bolt head shaft 26 and thus neutralizes the spring force.

This arrangement ensures that the bolt head, as soon as it is able to rotate into the barrel extension, automatically rotates in the direction of the full locking. On the other hand, as soon as the bolt head has been brought fully into the unlocked rotation position by the repeating process, this spring force no longer acts on the rotary motion of the bolt head and the further repeating path. Also, with a recoil triggered by firing, this acts in the opposite direction from the withdrawal direction of the control pin from the axial region 38 so that it counteracts an unwanted partial rotation of the bolt head 25 out from the bolt-locking region 10 and the breech is fully locked automatically.

The locking pawl 141, which neutralizes the spring force acting on the rotary motion, can also preferably be controlled from the outside in the fully locked rotation position of the bolt head, blocking an unwanted opening of the breech by engaging in the locking slit 53, for example when transporting the weapon.

For this purpose, the locking pawl 141 can preferably be triggered by the shooter by means of the mechanical safety of the weapon or it is separately embodied. Since this breech locking acts directly on the bolt head, the locked engagement means such as a bolt thread directly inhibits any axial movement of the bolt away from the direction of fire.

For the flat contact and the axial guidance—even if it is possible according to the invention to enable a direct locking of the bolt head in a correspondingly shaped bolt-locking region 10 of a barrel end in front of the cartridge chamber—it is preferable for the breech system to be embodied to produce a locking between a bolt head 25 of a bolt 3 and a bolt receiver 2; the bolt receiver 2 is embodied as a barrel extension or barrel receptacle for the barrel of a firearm.

For this purpose, the bolt receiver 2, as already explained above, is embodied with a barrel thread on the inside. The barrel receptacle 2 according to the invention also has at least one or more ring segment-like protrusions 55 on an outer circumference surface 12, in particular three ring segment-like protrusions 55, which are positioned one after another axially.

These protrusions 55 serve to engage in correspondingly embodied grooves (not shown) of a corresponding receiving sleeve of a firearm. The circumferential wall 12 of the barrel extension 4 or bolt receiver 4 on the one hand and the protrusions 55 on the other ensure a long cylindrical guidance in a corresponding hollow, cylindrical receptacle (not shown) and the protrusions 55 ensure a correspondingly precise and durable axial immobilization. The receptacle for the barrel extension 4 in this case is preferably a clamping sleeve. The ring segments 55 serve as breech lugs of a sort and preferably have an arc length of somewhat less than 180°. In this case, both the bolt receiver 2 and the barrel extension 4 with a barrel screwed into it in the direction of fire are slid into a corresponding receiving sleeve, which is in particular embodied as a clamping sleeve, of a firearm in the direction of fire and are then rotated by 180° until the ring segments are positioned entirely in corresponding grooves. Then a corresponding clamping can be produced so that an immobilization in every spatial direction is achieved.

Through the installation direction of the barrel/barrel extension from the rear in the direction of fire, it is possible to embody any attachments for the weapon—such as the hand guard or forestock—so that they follow the shape of the barrel contour, by contrast with the prior art of systems with an installation direction from the front into the weapon opposite from the direction of fire, which use the largest cross-sectional area of the barrel as the minimum clearance around it.

Particularly with the prior art up to this point, this results from accessory installations in which the mounting parts, for example screws, protrude radially inward toward the barrel and so must either be removed from the system before removal of the barrel or whose attachment points [hand guard] require a corresponding additional cross-sectional enlargement with the accompanying enlargement of the weapon.

According to the invention, it has turned out that in systems with axially clamped barrels/barrel extensions, the axial tensile force is not sufficient to cause an unwanted axial movement opposite from the direction of fire due to the recoil force and on the other hand, the friction force that predominates toward the end of the passage of the bullet through the barrel is not sufficient to cause a movement of the barrel/barrel extension in the direction of fire, which results in unwanted position changes and affects the function and precision.

The invention has the advantage that an extremely substantial breech for a firearm is produced since the locking according to the invention between the threads 16 and thread segments 44 results in a very large breech surface, which, due to the inclination of the thread combs 17 and 46 also leads to an intensified interlocking when under load. It is also advantageous that the positioning of the thread combs 17, 46 together with the defined rotation of the bolt head results in an extremely precise, exact, suction-assist engaged locking. In order to further improve this, the thread combs 46—in the regions in which they face the thread combs corresponding to them—can have slight beveling at the end so that the thread combs 44, 17 can slide into one another with even greater ease.

The apparatus of a rotating bolt head action with a bolt head 25, a bolt head shaft 26, and a bolt body 33 also enables a large amount of variability in the firearm because the actuation of this bolt 3 can take place by means of a bolt handle of the same kind as a straight-pull bolt-action rifle but also with a gas-powered unlocking and a bolt repeating motion by means of recoil and/or gas pressure on the one hand and forward motion by means of a bolt-closing spring so that this concept can be used to produce manual, semi-automatic, and automatic weapons.

The entire breech design will be described in greater detail below.

As has already been stated, the structural unit composed of the bolt head 25 and the bolt head shaft 26 is held in an axial bore of a bolt body 33; the bolt body 33 can slide axially on the bolt head shaft 26 (and vice versa). In addition, the bolt body 33 supports the control pin 36, which, during the sliding motion along the control surface 35 or a correspondingly shaped control notch 35, produces a rotation of the bolt head shaft and thus of the bolt head.

In an advantageous embodiment, the bolt head shaft 26 on the one hand and the bolt body 33 on the other are supported on a bolt carrier 60. In this embodiment, the bolt head shaft 26 is supported on the bolt carrier 60 in a rotatable, but axially fixed way, while the bolt body 33 is supported on the bolt carrier 60 in an axially sliding, but rotationally fixed way.

The bolt carrier 60 has a bolt carrier plate 61 and protruding from it in the same direction, has two bolt carrier/longitudinal carrier arms 62, 63 and, protruding from them, respective ejector arms 64, 65.

The bolt carrier plate 61 is a flat, plate-like component, which, in relation to the longitudinal span of the bolt head shaft 26 and the direction of fire, is embodied standing upright and has an essentially rectangular cross-section.

As a result, the bolt carrier plate 61 has a front wall 66, a back wall 67, two narrow side edges 68, a lower edge 69, and an upper edge 70.

Approximately in the middle between the narrow side edges 68, leading from a lower edge 69, there is a support opening 71 for a bolt head shaft. In this case, the support opening 71 has a circular segment-shaped region 73, which reaches from the back wall 67 to approximately half of the transverse center of the thickness of the bolt carrier plate 61. From the front wall 66, the opening 71 is embodied with straight engaging wall sections 73 on both sides, which, at the top, transition into an approximate arc 74 or are joined thereto.

The opening and in particular the round opening region 72 and straight wall sections 73 as well as the distance between them are dimensioned so that in the round opening region 72, an end region 74 of the bolt head shaft 26 is supported, while the straight wall sections 73 can engage as tongues 73 for a circumferential groove 75, which is positioned adjacent to the region 74 in the bolt head shaft 26.

This makes it possible to position the bolt head shaft 26 in the support opening 71 so that it is axially fixed, but able to rotate between the wall sections 73.

The upper edge 70 of the bolt carrier plate 61 has two steps 76, which extend obliquely upward and thus, spaced apart from the narrow side walls 68, increase the height of the bolt carrier plate 61 in an upward direction and at the top, lead into a top surface 77 extending parallel to the upper edge 70. A control surface 78 is embodied so that it slopes downward from the top surface 77 in the middle toward the back wall 67; the control surface 78 extends from the back wall 67 to approximately the longitudinal center of the top surface 77 and from there, is extended with a control projection 79, which has an upper rounded end. The purpose of the control surface 78 and control projection 79 is to tension the hammer of a lock (not shown) as the bolt returns.

Adjacent to the support opening 71, on both sides of the support opening 71, long grooves 80 that are rectangular in cross-section are let into the bolt carrier plate 61, which each extend parallel to the lower edge 69 and upper edge 70, a short distance toward the narrow side walls 68. From the lower edge 69, narrow, oblique wall sections 81 extend to the support opening 71 or more precisely, to a lower edge of the groove 80.

At the bottom, ending with the lower edge 69 of the bolt carrier plate 61, two bolt carrier/longitudinal carrier arms 62 extend forward perpendicular to the plane of the front wall 66 of the bolt carrier plate 61 on both sides of the support opening 71 and symmetrically relative to the transverse center. The bolt carrier/longitudinal carrier arms 62 are embodied as essentially block-shaped, with a flat outer wall 84, an upper wall 86 extending transversely thereto, a flat lower wall 87 initially extending parallel thereto, and an inward-facing wall region 85.

The outer walls 84 are spaced apart from the narrow side walls 68 so that a step is formed between the narrow side walls 68 and the outer walls 84.

The upper wall 86 and lower wall 87 are embodied extending parallel to the upper edge 70 and top surface 77, but spaced apart from the upper edge 70.

The lower walls 87 are embodied with an initially flat region so that they end at a lower edge 69 of the bolt carrier plate 61 and extend the latter toward the front.

The inner walls 85 are embodied so that they extend the oblique surfaces 81 adjacent to the grooves 80; in the inner walls 85, there are corresponding grooves 88 that extend the grooves 80. Upper wall sections of the inner walls 85 between the grooves 88 and the upper wall 86 are embodied as recessed relative to the straight wall sections 73.

The bolt carrier/longitudinal carrier arms 62 also have flat front surfaces 89, which are positioned extending parallel to the plane of the front wall 66 and back wall 67 of the bolt carrier plate 61.

From the front or end surfaces 89 of the bolt carrier/longitudinal carrier arms 62 to approximately one third the longitudinal span of the bolt carrier/longitudinal carrier arms 62 from the bolt carrier plate 61 to the end surfaces 89, the lower wall 87 is embodied as rounded, with a rounded region 90, which extends in a rounded, arc-shaped way from the outer walls 84 to the oblique surfaces 81.

The respective ejector arm 64, 65 is placed onto the end surfaces 89 and likewise positioned extending toward the front. The ejector arms 64, 65 are ring segment-shaped in cross-section, with a flat upper wall 92, a respective ring segment-shaped outer wall 93, and a ring segment-shaped inner wall 94.

The ejector arms 64 also each have a flat lower wall 96 and front end surfaces 95. The end walls 95 in this case extend parallel to the end walls 89, the upper wall 92 and the lower wall 96 respectively extend parallel to each other and parallel to the walls 86 and the flat regions of the walls 87.

The width of the ejector arms 64, 65 between the ring segment-like outer walls 93 and inner walls 94 is for example approximately half the width of the bolt carrier/longitudinal carrier arms 62 in the region of their upper wall 86. The walls 93, 94 are thus recessed from the walls 85, 84;

in the region of the oblique surfaces, the lower wall 96 ends along with them by means of a likewise oblique surface.

The shape of the ejector arms 64, 65 is matched to the shape of the slots 14 between the cylinder segments 11 of the bolt-locking region 10 of the barrel extension 4 and bolt receiver 2 so that the ejector arms 64, 65 engage in the grooves in a way that is as form-fitting as possible and thus are also shaped to fit the cylinder segments 11 so that in the closed state of the breech, of the barrel extension, and of the bolt receiver, this closes the arc of the cylinder segments 10.

Adjacent to the end surfaces 95, spaced approximately equidistantly between the walls 92, 96, a T-groove 97 is provided in such a way that the end walls 95 form corresponding undercuts 98 behind which the groove correspondingly widens into the shape of a T crossbar. In each of the grooves 97, a respective ejector claw is supported, which forms a flat back wall 100 for being supported against the flat end surface 95 or flat end wall 95 of the ejector arms 64, 65 and toward the front, extending from a top to a bottom, is embodied with a curvature 101; the curvature 101 is embodied as rounded and if need be arc-shaped in such a way that it corresponds to a curvature at the end of the slots 14. The ejector claws 99 are therefore embodied so that they are able to move radially inward and outward in the T-grooves 97 by means of corresponding T-shaped formations 102, which extend away from the back wall 100.

From the groove bottom 103 oval or flat heart-shaped bores 104 extend longitudinally through the ejector arms 64, 65, which also extend with an enlarged rounded cross-section through the bolt carrier/longitudinal carrier arms 62, 63 and also extend longitudinally through the bolt carrier plate 61.

As the bore 104 extends through the bolt carrier/longitudinal carrier arms and the ejector arms 64, 65, a step (not shown) is provided, for example, as a counter support for an adjusting screw (not shown). By turning the adjusting screw (not shown), which is correspondingly screwed axially into the ejector claws 99 or acts on them by means of a cam, the ejector claws 99 can be moved outward or inward in the grooves 97 by means of the T-formation 102 so that either one ejector claw 99 or both ejector claws 99 can engage in an intrinsically known way in the ejector notch of a cartridge.

Preferably, only one ejector claw engages, which results in the fact that by means of a cartridge ejector (not shown) on the one hand and the ejector claw, which is present and engages on only one side, the ejection direction of the cartridge can be set toward one side or the other.

The ejector claw 99 has a respective outer wall 105; the outer wall 105 is shaped to correspond to the outer wall 93 so that in an outer position, in which it cannot engage in a cartridge ejector notch, the ejector claw ends flush with the wall 93, or in the outer position, in which it does not engage, it protrudes beyond the outer wall 93.

If the ejector claw is activated, its outer surface 105 is recessed relative to the outer wall 93 of the ejector arm 64, 65 by the amount by which it protrudes inward or it ends flush with it corresponding to the second alternative described above.

The ejector claws 99 are positioned relative to the bolt head 25 in such a way that the bolt head is affixed to the bolt carrier plate 61 by means of the bolt head shaft 26 and its end or flute is also spatially positioned in relation to the breech face of the bolt head in such a way that an inward-extending engagement edge is positioned at the corresponding height of the cartridge ejector notch of a cartridge.

The bolt body 33 is a component with an essentially T-shaped cross-section, with one component region 110 extending transversely and one component region 111 extending essentially upright. The proportions in this case are approximately such that the width of the transversely extending component region 110 is approximately three times the width of the upright extending component region and the thickness of the transversely extending component region from bottom to top is approximately the length of the longitudinally and upright extending component region 111.

The transversely extending component region 110 here is embodied as plate-like, with a rear end wall 112, two longitudinal side walls 113, and a front end wall 114. Between the front and rear end walls 112, 114 and the longitudinal side walls 113, there is a lower wall 115.

Between the upper edges of the longitudinal side walls 113, there is an upper wall 116.

The upright extending component region 111 extends centrally downward from the middle of the lower wall 115, i.e. away from the lower walls 115, with side walls 117, which extend parallel to the side walls 113 of the transversely extending component region 110 and orthogonal to the lower wall 115. The side walls 117 here are spaced symmetrically apart from the side walls 113. The component regions 110, 111 have shared rear and front end walls 112, 114.

Between the end walls 117, there is a bottom wall 118 of the component region 111 and in its longitudinal middle, the bottom wall 118 has an aperture 119, which is embodied in the cylindrical bore 34 extending coaxially around the longitudinal axis of the bolt body 33 and a bolt head shaft 26.

The bottom wall 118 widens outward beyond the respective side wall 117 with a tongue section 120, which is respectively embodied as elongated and block-shaped and is positioned on the outer wall 117 and thus widens the outer wall 117 with a step 121. The distance between the step 121 and bottom wall 118 extending parallel thereto corresponds to the height of the groove 80 in the bolt carrier plate 61 and the bolt carrier/longitudinal carrier arms 62; the projection of the tongue elements 120 beyond the side wall 117 corresponds to the depth of the grooves 80. The elements 120 are thus correspondingly embodied to be received in the groove 80.

The height of the side walls 117 between the elements 120 and the lower wall 115 of the component region 110 is greater than the distance of the grooves 80 from the upper surface 86 of the bolt carrier/longitudinal carrier arms 62, 63 in the region of their inner walls 85 so that in the inserted state of the bolt body 33, a gap remains between the upper walls 86 of the bolt carrier/longitudinal carrier arms 62, 63 on the one hand and the lower wall 115 of the transversely extending component region 110 of the bolt body 33 on the other.

Consequently, the tongue projections 120 on the one hand and the grooves 80 on the other form a tongue-and-groove system with which the bolt body 33 can be positioned in the bolt carrier 60 in a longitudinally sliding fashion.

The upper wall 116 of the component region 110 thickens by means of two steps extending obliquely upward 124 to an upper top surface 125.

The steps 124 are each spaced slightly apart from the side walls 113 and in terms of their height and their shape, corresponding to steps 76; in terms of its lateral span, the surface 125 corresponds to the upper edge 77 of the bolt carrier plate 61 so that the correspondingly embodied edges end at the same time as each other. From one side, a for example rectangular transverse notch 126 is milled into a step 124 and feeds into a through bore 127, which is let into the bolt body 33, passing through it orthogonal to the upper top surface 125 and reaching to the bottom wall 118 of the component region 111 and thus passing all the way through the bolt body 33, for example vertically.

The bore 127 in this case has a diameter, which is matched to the outer diameter of a control pin 36; the bore is embodied so that in the region of the longitudinal bore 34, it extends laterally only partway in the wall 117 that delimits the bore 34 so that the control pin 36 reaches laterally into the bore 34.

Adjacent to the longitudinal side walls 113 there are spring receiving bores 129 extending all the way from the end surface 114 to the end surface 112. These bores 129 are embodied as wider in the region of the end wall 114 and are embodied as narrower in the region of the end wall 112. The bores 129 thus narrow in the course of their path from the end wall 114 to the end wall 112 with a step 132. In the narrower region of each bore 129, a respective pressure pin 130 is preferably provided, which is supported with a shaft 133 in the narrower region of the bore 129 and is positioned with a wider region 134, particularly in the form of a nail head, in the wider-diameter region of the bore 129. In this case, the pressure pin 130 is dimensioned so that on the one hand, in the narrower-diameter region of the bore 129, it has the diameter of the bore and is able to slide longitudinally in it, but is delimited by the step 132. When the wider region rests against the step, the pin preferably protrudes a desired amount beyond the end wall 112. In order to act on the pressure pin 130 with spring pressure, the wider region of the bore 129 contains a compression spring (not shown), in particular a spiral compression spring, which preferably has a diameter that corresponds to the inner diameter of the wider region of the bore 129.

This compression spring is secured in the bore 129 under pressure by means of corresponding screws (not shown), which are screwed into a corresponding internal thread of the bore 129 in the vicinity of the mouth of the wider region of the bore 129 in the vicinity of the end surface 114.

If need be, the thread can reach deep enough into the bore 129 and the screw can be embodied as a set screw so that the spring pressure can be adjusted by screwing the set screw (not shown) to different depths.

In a home position, the screws, in particular set screws (not shown), preferably end at the end wall 114 and do not protrude beyond it.

To support the pressure pins 129 flush with the bore 129, blind bores 131 are provided in the front wall 66 of the bolt carrier plate 60 (FIG. 15, 16), which engage with the free ends of the pins 129.

Adjacent to the bore 127, the upper top surface 125 is provided with a longitudinally extending slit 134, which extends axially into the bolt body 33 spaced apart from the end walls 112, 114. Adjacent to the end wall 112, the slit 134 pierces the component region 110 into the bore 34; the length of the piercing part of the slit makes up a quarter to a third or more of the total length of the slit 134. The mouth 135 of the slit 134 in the bore 34 is located, for example, in the longitudinal middle of the bore 34. A lateral channel 137 extends from an end 136 of the slit 134 situated closer to the end wall 114. In the channel bottom 138 of the channel 137, a vertical bore 139 is provided for receiving a spring and/or a spring-loaded pin. In addition, parallel to the slit 134, there is a flat rectangular channel 140 extending from the end wall 112 to the end wall 114; the rectangular channel 140 does not have the depth of the channel 137, toward a wall 113 and away from the slit 134, but ends at it and sweeps across it.

A locking lever 141 is supported in the slit 134 and the channel 137.

The locking lever 141 is a flat, oblong component, which is received in an upright position in the longitudinal slit 134 and is positioned so that it is able to tilt in the slit 134 around a rotation axis (not shown) in such a way that a catch projection 142, which is embodied at one end of the locking lever, extends downward through the mouth into the region of the bore 34 and can be pivoted into and out of this region of the bore 34.

For this purpose, at its opposite end, the locking lever 141 has an actuating lever 143, which can be supported in the channel 137 and in particular, is loaded by the spring supported in the bore 139 or by the spring pressure pin supported in the bore 139 and pivoted around its rotation axis so that the catch projection 142 is pivoted through the mouth 134 into the bore 34 by means of spring pressure.

The channel 140 serves to receive and guide an actuating element and a control surface with which the actuating lever 143 can be pressed into the channel 137 in opposition to the pressure of the spring supported in the bore 139 so that in the pressed-in state of the actuating lever, the catch 142 is pivoted through the mouth 135 out of the region of the bore 34; for the functionality of the breech, it is sufficient if an actuating element 146 is present.

On the lower wall 115 of the component region 110, in particular symmetrically between the longitudinal path of the bores 129 and the walls 117 of the component region 111 longitudinally or axially extending receiving slots 145 are provided, but these do not extend through to the walls 112, 114, their slot ends instead being spaced apart from them.

These slots 145 are each used to receive and affix a respective actuating element 146. The actuating element 146 has a connecting plate 147, which has a width that corresponds to the distance between the side wall 117 and the side wall 113. The connecting plate 147 also has a length that corresponds to the length between the end walls 112, 114 so that the plate completely covers the respective underside sections of the underside between the longitudinal walls 113 and the end walls 112, 114 on the one hand the side wall 117 on the other. On top, the connecting plates 147 each have a tongue element for engaging in the slots 145 so that the connecting plate 147 is affixed to the bolt body 33 in both the longitudinal and the transverse direction.

Transverse to the connecting plate 47, extending from an upper surface 116 of the component region 110 and ending flush with it, there is an outer plate 148, which has the same dimension in the longitudinal direction as the connecting plate 147 and is embodied of one piece with it. With a short region 149, the plate 148 completely covers the outer wall 113 and extends downward beyond the connecting plate 147 and bottom walls 118 to a lower edge 150, on which, protruding beyond an inner wall 151 of the plate 148, a connecting tongue 152 or connecting projection 152 is positioned, with which the actuating element 146 and thus the bolt body 33 can be attached to an actuating rail 153. The actuating rail 153 in this case has a corresponding recess 154 or a corresponding slit 154 in the region of the projection 152. The actuating rail 153 extends in the direction of the weapon toward the muzzle, i.e. toward the front, and at its front end, is used for attaching a bolt handle (not shown) so that the bolt can be started and moved from a region equipped with a bolt handle and situated very far forward on the weapon.

As has already been explained, a respective actuating element 146 and actuating rail 153 can be positioned on each bolt body side, but it is sufficient if the corresponding element is present on the side on which the shooter would have to carry out the repeating action.

Through the symmetrical embodiment, both of the actuating element 146 and of the actuating rail 153, a weapon can be adapted to the needs of the shooter by positioning these elements on the respective side of the bolt body.

If for reasons of symmetry, two actuating elements 146 and two actuating rails 146, 153 are present, then it is sufficient, for example, to relocate the bolt handle from the one side to the other.

If only one actuating element 146 and thus also only one actuating rail 153 is positioned on the bolt body, then only one connecting plate is present on the other side in order to be able to close the slit between the underside 115 or lower wall 115 of the component region 110 on the one hand and the upper wall 86 of the bolt carrier/longitudinal carrier arms 62, 63 on the other and to produce a form-fitting engagement.

In the assembled state, the actuating element 146 with the actuating plate 148 rests against the respective outer wall 84 of the bolt carrier/longitudinal carrier arms 62, 63 and extends beyond their lower walls 87.

The function of the breech should be explained once again below. The different embodiments according to FIGS. 1-4 and 5-32 basically have the same functionality, even if in FIGS. 1-4, the bolt body is a cylindrical sleeve, which has a through opening for a control pin, while in the second embodiment, it is not a slit in the bolt head shaft, but rather a control surface in the bolt head shaft. The functionality in this case is the same since in both cases, except for a rotatability and a longitudinal mobility, the bolt head shaft 26 is supported is a fixed way and thus even in the second embodiment, the bolt head shaft 26 or more precisely the control notch 35 cannot move out of the way of the control pin 36.

According to the second embodiment, first and second locking slits 53, 54 are positioned in the bolt head shaft 26 (FIG. 31).

The first and second locking slit 53, 54 are axial slits in the surface of the bolt head shaft 26, which are embodied so that they can correspond to the catch 142 of the locking lever 141. In FIGS. 29, 30, 31, and 32, the control pin 36 and the locking pawl 141 are each shown only with regard to their function, but not their complete spatial positioning in the bolt body 33 in order to be able to better explain the function.

The first and second locking slit 53, 54 are embodied axially offset from each other and also radially offset from each other; the second slit 54 is farther away from the bolt head 25 than the first slit 53, but is positioned before the first slit 53 in the rotation direction of the bolt. In this case, the axial spacing of the slits 53, 54 corresponds to the depth to which the bolt threads are screwed into each other, while the radial spacing corresponds to the arc length that the bolt travels in the screwing-in direction until the end of the screwing-in motion. This means that with an opening or closing angle of 60° of the bolt head in the bolt receiver, the arc spacing between the two slits 53 and 54 is likewise 60°.

As already explained, the rotation of the bolt head 25 is produced by means of an advancing motion of the bolt body 33 (not shown in FIGS. 29 to 32). In this case, the bolt body slides on the bolt head shaft 26; the control pin 36, which rests (FIG. 21) in its control pin bore 127 (FIG. 20), slides along the control surface 35 and forces the bolt head 25 into a rotary motion toward the right (in FIGS. 29 to 32). The initial position is shown in FIG. 30.

In this case, the control pin 36 rests against the axial formation 40 of the control surface 35. With the forward motion, the rotation of the bolt head 25 according to FIGS. 29 and 30 takes place. The inclined surface 39 of the control surface 35 in this case is shaped exactly so that the angular offset between the axial regions of the control surface 35, namely the regions 40 and 38, corresponds to the angular offset (60° in in this case), that is traveled by the bolt head 25 when it is screwed in all the way.

Both the open position (FIGS. 30 and 32) and the closed position (FIGS. 29 and 31) are preferably lockable.

In the open position, it is possible for the bolt to be slid all the way to the stop with its flutes 45 in the region of the thread 16 of the bolt receiver and for its threads 44 to be slid all the way into the slots 14. In order to then cause the threads 16, 44 to travel all the way into each other, the corresponding rotation of the bolt head is required. This position is then the closed position corresponding to FIGS. 29 and 31.

In the open position (FIGS. 30 and 32), the locking lever 141 is able to lock this position with the catch projection 143 then the latter engages in the slit 54. This is caused by the fact that the actuating lever 143, which is embodied at the opposite end of the locking lever 141, is spring-loaded and thus can allow the catch projection 142 to protrude into the slit 54 by means of spring pressure. In this position, a movement of the bolt body 33 against the bolt head shaft 26 is not possible since bot a radial motion and an axial motion are inhibited by the locking lever 141.

If the locking lever 141 is lifted out of the slit 54 due to pressure on the actuating lever 143 from above, then the locked and closed position of the breech shown in FIGS. 31 and 29 can be produced in which the spring-loaded actuating lever 143 once again pivots the locking lever 141 so that this time, the catch projection 142 protrudes into the slit 53 positioned axially more toward the front.

As already explained above, however, the rotary motion of the bolt head is particularly aided or produced by compression springs acting between the bolt carrier 60 and the bolt body 33.

The locking lever 141 can particularly be actuated by means of the lock of the firearm and in this case, particularly also the safety slider or lever so that when the safety is activated, the closed position and/or the open position are locked. The locking of the open position is particularly useful if a spring pressure acts between the carrier and the bolt body as provided according to the invention since otherwise, this spring pressure may possibly cause a rotary motion into the closed position.

Preferably, the locking lever 143 is pivoted so that the moment the bolt head protrudes into the bolt receiver, the bolt head is released. A rotation of the bolt head would then be possible, but is inhibited until the position is reached in which the threaded sections can slide into one another.

With the invention, it is advantageous that by means of the modular design of the bolt composed of a bolt head 25 with a bolt head shaft 26 on the one hand and with a bolt carrier to which the bolt head shaft is axially fixed as well as a bolt body, which is able to slide axially to a limited degree on the bolt carrier and on the bolt head shaft, an extremely reliable system is achieved, which has a very high operational safety and ease of maintenance and by means of the clever arrangement of the mechanical elements—particularly also of the externally actuatable locking lever—enables an error-free function and error-free, simple operability.

REFERENCE NUMERAL LIST

1 breech system
2 bolt receiver

3 bolt
4 barrel extension
5 front opening
6 rear opening
7 barrel receptacle thread
8 smooth region
9 stop
10 bolt-locking region
11 cylinder segment
12 circumferential wall
14 slots
15 end wall
16 thread
17 thread comb
18 front flank
19 rear flank
20 smooth region
21 smooth region
22 axial stop surface
25 bolt head
26 bolt head shaft
27 through bore
29 through bore
30 firing pin tip
31 firing pin
32 firing pin spring
33 bolt body
34 central bore
35 control recess
36 control pin
37 front end
38 axial region
39 oblique region
40 axial stop collar
41 front edge
42 rear edge
43
44 thread segment
45 flutes
46 thread combs
47 front flank
48 rear flank
49 axial groove
50 smooth region
51 breech face
52 front edge
53 locking slit
54 locking slit
55 ring segment
59 ring segment
60 bolt carrier
61 bolt carrier plate
62 bolt carrier longitudinal carrier arm
63 bolt carrier longitudinal carrier arm
64 ejector arm
65 ejector arm
66 front wall
67 back wall
68 narrow side edge
69 lower edge
70 upper edge
71 support opening
72 round opening region
73 wall section
74 end region front wall of 61
75 circumferential groove
76 step
77 top surface
78 control surface
79 control projection
80 rectangular groove
81 oblique wall section
82 end region of 26
83 groove in the end region 74
84 outer wall steps
85 inner wall
86 upper wall
87 lower wall
88 groove
89 flat front surface
90 rounded region
92 upper wall outer wall of 62/63
93 ring segment-shaped outer wall
94 ring segment-shaped inner wall
95 front end surface/end wall
96 lower wall
97 T-groove end surface
98 undercuts
99 ejector claw
100 back wall
101 curvature
102 T-shaped formation
103 groove bottom
104 flat heart-shaped bores
105 outer wall
110 transverse component region
111 upright component region
112 rear end wall
113 longitudinal side wall
114 front end wall
115 lower wall
116 upper wall
117 side walls
118 bottom wall
119 aperture
120 tongue section
121 step
124 step extending obliquely upward
125 upper top surface
126 rectangular transverse notch
127 through bore
129 spring receiving bores
130 pressure pin
131 blind bores
132 step
133 shaft
134 slit
135 mouth
136 end
137 lateral channel
138 channel bottom
139 vertical bore
140 rectangular channel
141 locking lever
142 catch projection
143 actuating lever
145 slots
146 actuating element
147 connecting plate
148 plate
149 short region
150 lower edge
151 inner wall
152 connecting projection

153 actuating rail
154 recess

The invention claimed is:

1. A breech system for a firearm, having a bolt receiver (2) and a bolt (3); the bolt receiver (2) being in the form of a hollow cylinder with at least one first engagement means (16) protruding radially inward and at least one slot (14); the slot (14) being positioned axially adjacent to the first engagement means (16) and to a bolt head (25), the bolt head having at least one protruding second engagement means (44) and an adjacent axial flute (45); the first engagement means (16) of the bolt receiver (2) and the second engagement means (44) of the bolt head (25) are correspondingly embodied as being able to engage with each other, characterized in that the corresponding first and second engagement means (16, 44) are embodied as receiving and bolt thread segments, respectively (16, 44), with or without a pitch; the respective thread segments (16, 44) each having at least one thread comb (17, 46); and a rear flank (19) of the at least one thread comb (46) of the bolt head (25) is inclined away from the direction of fire and a corresponding rear flank (48) of the at least one thread comb (17) of the bolt receiver (2) is inclined in the direction of fire.

2. The breech system according to claim 1, characterized in that the thread combs (17, 46) are embodied as sharp thread combs or trapezoidal thread combs with inclined front flanks (18, 47) and inclined rear flanks (19, 48).

3. The breech system according to claim 2, characterized in that the front flanks (18, 47) and rear flanks (19, 48) have different inclinations.

4. The breech system according to claim 1, characterized in that the thread segments (16, 44) have a pitch, and a pitch of each thread comb (17, 46) is the same as the pitch of each respective thread segment (16, 44).

5. The breech system according to claim 1, characterized in that the bolt head (25) is supported in rotary fashion on a bolt carrier (60) and there is also a bolt body (33), which is able to slide on a bolt head shaft (26) of the bolt head (25), and between the bolt body (33) and the bolt carrier (60), there is at least one compression spring, which tends to move the bolt body (33) in the direction toward the bolt head (25); and on the bolt head shaft (26) and on the bolt body (33), there are means (35, 36) that produce a rotation of the bolt head (25) when the bolt body (33) is slid on the bolt head shaft (26).

6. The breech system according to claim 1, characterized in that the bolt receiver (2) has a plurality of cylinder segments (11), each with a respective receiver thread segment (16) having at least one thread comb (17); and between the cylinder segments (11), there are slots (14); and the slots are positioned in a circumferential wall (12) of the bolt receiver (2) from a radial inside to a radial outside and extend into the circumferential wall (12) at least to a bottom of each thread comb (17) or extend all the way through the cylindrical circumference wall (12).

7. The breech system according to claim 1, characterized in that a plurality of bolt thread segments (44) with respective thread combs (46) are embodied on the bolt head (25); and adjacent to the bolt thread segments (44), there are flutes (45), which at least reach the depth of bottoms of the thread combs (46) so that the flutes (45) interrupt a thread helix of the thread combs.

8. The breech system according to claim 6, characterized in that a radial width of the slots (14) corresponds to a radial width of the thread segments (44) and a radial width of the flutes (45) of the bolt head corresponds to a radial width of the cylinder segments (11).

9. The breech system according to claim 1, characterized in that the bolt (3) has the bolt head (25), a bolt head shaft (26) adjoining the bolt head (25) and extending axially in a direction away from a direction of fire, and a bolt body (33) positioned around the bolt head shaft (26), the bolt body (33) being supported in a rotationally fixed way so that it is able to slide axially in a firearm, and located between the bolt body (33) and bolt head shaft (26), a control slide comprising a control recess (35) and a control pin (36) is provided, which supports the bolt head shaft (26) so that it is able to rotate to a limited degree in the bolt body (33).

10. The breech system according to claim 1, characterized in that the bolt head (25) has at least one thread comb (46), which is embodied so that it extends from a bolt thread segment (44) into the flute (45) and spans the flute (45) and has an axial free end (52) that forms a stop surface (52) for a corresponding stop surface (22) of a cylinder segment (11) so that when the thread comb (46) fully engages in the thread comb (17), a further screwing of the thread comb (46) into the thread comb (17) and thus a further screwing of the bolt thread segment (44) into the receiver thread segment (16) or cylinder segment (11) is blocked.

11. The breech system according to claim 1, characterized in that the bolt receiver (2) is embodied in a barrel extension (4); the barrel extension (4) is embodied to receive the barrel of a firearm; in addition to a bolt-locking region (10) for receiving the bolt (3) and the bolt head (25) of the bolt (3), the barrel extension (4) has a locking region; and in the locking region, there is at least one ring segment-like protrusion (55), which is embodied to cooperate with a corresponding groove in a sleeve or chassis of a firearm.

12. The breech system according to claim 5, characterized in that the bolt head shaft (26) and the bolt body (33) are supported on the bolt carrier (60); the bolt head shaft (26) is supported on the bolt carrier (60) in a rotatable, but axially fixed way, while the bolt body (33) is supported on the bolt carrier (60) in an axially sliding, but rotationally fixed way.

13. The breech system according to claim 5, characterized in that the bolt carrier (60) has a bolt carrier plate (61) and, protruding from it in a same direction, first and second bolt carrier longitudinal arms (62, 63) and, protruding from the first and second carrier arms, respective first and second ejector arms (64, 65); wherein the bolt carrier plate (61) is a flat, plate-like component, which, in relation to a longitudinal span of the bolt head shaft (26) and a direction of fire, is embodied standing upright and has a generally rectangular cross-section; and between narrow side edges (68) of a lower edge (69) of the bolt carrier plate (61), there is a support opening (71) for the bolt head shaft (26) so that by means of a groove and tongue engagement, the bolt head shaft (26) is supported on the bolt carrier plate (61) in a rotatable but axially fixed way.

14. The breech system according to claim 13, characterized in that the bolt body (33) is a component with a generally T-shaped cross-section, with a first component region (110) extending transversely and a second component region (111) extending essentially upright; the first component region (110) is embodied as plate-like, with a rear end wall (112), two longitudinal first side walls (113), and a front end wall (114); between the front and rear end walls (114, 112) and the longitudinal first side walls (113), there is a lower wall (115); the second component region (111)

extends downward from the middle of a lower wall (150) with two second side walls (117) that extend parallel to the first side walls (113); the second side walls (117) are spaced apart from the first side walls (113) in an essentially symmetrical fashion; between the second side walls (117), there is bottom wall (118) of the second component region (111); and in a longitudinal middle of the bottom wall (118) is an aperture (119), which is embodied in a cylindrical bore (34) extending coaxially around a longitudinal axis of the bolt body (33) and the bolt head shaft (26).

15. The breech system according to claim 14, wherein when the bolt body (33) is inserted in the bolt carrier (60) a gap remains between the walls of first and second the bolt carrier longitudinal arms (62, 63) and the lower wall (115) of the first component region (110) of the bolt body (33); the bottom wall (118) widens outward beyond the respective second side walls (117) with tongue elements (120) and corresponding grooves (80) present in the bolt carrier plate (61) and bolt carrier longitudinal arms (62, 63); projection of the tongue elements (120) beyond the second side walls (117) corresponds to a depth of the grooves (80) so that the tongue elements (120) are correspondingly embodied to be received in the grooves (80) and form a tongue-and-groove system with which the bolt body (33) is positioned in the bolt carrier (60) in a longitudinally sliding fashion.

16. The breech system according to claim 5, characterized in that a locking lever (141) is supported in an upper top surface (125) of the bolt carrier (60); the locking lever (141) is positioned so that it is tilted around a rotation axis into a slit (134) in such a way that a catch projection (142), which is embodied at one end of the locking lever (141), reaches into a region of a bore (34) for supporting the bolt head shaft (26) and in this region of the bore (34) can be pivoted into and out of the bore; and the locking lever (141) has an actuating lever (143), which is spring-loaded by the pressure of a spring in such a way that the catch projection (142) is pivoted through the slit (134) into the bore (34) by means of spring pressure.

17. The breech system according to claim 5, characterized in that first and second locking slits (53, 54) are provided in the bolt head shaft (26); the first and second locking slits (53, 54) are axial slits positioned in the surface of the bolt head shaft (26); the first and second locking slits are embodied so that they can correspond to the catch (142) of the locking lever (141); the first and second locking slits (53, 54) are embodied as axially offset from each other and radially offset from each other; the second slit (54) is farther away from the bolt head (25) than is the first slit (53), but is positioned before the first slit (53) in the rotation direction of the bolt; and the axial spacing of the slits (53, 54) corresponds to a depth to which the bolt threads are screwed into each other, while the radial spacing corresponds to an arc length that the bolt travels in a screwing-in direction through a complete screwing-in motion.

18. The breech system according to claim 5, characterized in that the rotation of the bolt head (25) can be produced by means of an advancing motion of the bolt body (33); wherein, the bolt body slides onto the bolt head shaft (26) and a control pin (36), which rests in a control pin bore (127), slides along a control surface (35) and forces the bolt head into a rotary motion; wherein in an initial position, the control pin (36) rests in an axial recess (40) of the control surface (35) and with a forward motion, forces the rotation of the bolt head; and an inclined surface (39) of the control surface (35) is configured so that an angular offset between axial end regions (40, 38) of the control surface (35), corresponds to an angular offset by which the bolt head (25) travels when it is completely screwed in.

* * * * *